US010827292B2

(12) United States Patent
Hall et al.

(10) Patent No.: US 10,827,292 B2
(45) Date of Patent: Nov. 3, 2020

(54) SPATIAL AUDIO AGGREGATION FOR MULTIPLE SOURCES OF SPATIAL AUDIO

(71) Applicant: JAWB Acquisition LLC, New York, NY (US)

(72) Inventors: James Hall, Sunnyvale, CA (US); Thomas Alan Donaldson, Nailsworth (GB)

(73) Assignee: JAWB ACQUISITION LLC, New York, NY (US)

( * ) Notice: Subject to any disclaimer, the term of this patent is extended or adjusted under 35 U.S.C. 154(b) by 0 days.

(21) Appl. No.: 14/215,051

(22) Filed: Mar. 16, 2014

(65) Prior Publication Data

US 2014/0270188 A1 Sep. 18, 2014

Related U.S. Application Data

(60) Provisional application No. 61/786,445, filed on Mar. 15, 2013.

(51) Int. Cl.
*H04S 5/00* (2006.01)
*H04S 7/00* (2006.01)

(52) U.S. Cl.
CPC ..... *H04S 5/00* (2013.01); *H04S 7/303* (2013.01)

(58) Field of Classification Search
CPC .... H04R 1/32; H04R 1/34; H04R 5/02; H04S 5/00; H04S 7/303
See application file for complete search history.

(56) References Cited

U.S. PATENT DOCUMENTS 6,243,476 B1 * 6/2001 Gardner ..... H04S 1/007 381/1
6,275,722 B1 8/2001 Van Joop et al.
(Continued)

FOREIGN PATENT DOCUMENTS

WO 2013016735 A2 1/2013
WO 2014145133 A2 9/2014
(Continued)

OTHER PUBLICATIONS

Thomas, Shane; International Searching Authority; Notification of Transmittal of the International Search Report and Written Opinion of the International Searching Authority of the Declaration for International Patent Application No. PCT/US2014/030885, dated Sep. 15, 2014.
(Continued)

*Primary Examiner* — Brenda C Bernardi
(74) *Attorney, Agent, or Firm* — Hard IP LLC

(57) ABSTRACT

Various embodiments relate generally to electrical and electronic hardware, computer software, wired and wireless network communications, and audio and speaker systems. More specifically, disclosed are an apparatus and a method for processing signals for optimizing audio, such as 3D audio, by adjusting the filtering for cross-talk cancellation based on listener position and/or orientation. In one embodiment, an apparatus is configured to include a plurality of transducers, a memory, and a processor configured to execute instructions to determine a physical characteristic of a listener relative to the origination of the multiple channels of audio, to cancel crosstalk in a spatial region coincident with the listener at a first location, to detect a change in the physical characteristic of the listener, and to adjust the cancellation of crosstalk responsive to detecting the change
(Continued)

in the physical characteristic to establish another spatial region at a second location.

20 Claims, 18 Drawing Sheets

(56) References Cited

U.S. PATENT DOCUMENTS 6,741,273 B1 * 5/2004 Waters ..... H04S 7/302 348/61
6,862,356 B1 * 3/2005 Makino ..... H04S 7/302 381/1
7,860,260 B2 * 12/2010 Kim ..... H04S 7/302 381/17
7,894,877 B2 2/2011 Lewin et al.
7,929,720 B2 * 4/2011 Ishibashi ..... H04S 7/302 381/300
8,249,298 B2 * 8/2012 Saleh ..... G01S 3/808 382/103
8,320,592 B2 11/2012 Kim
8,331,614 B2 * 12/2012 Mannerheim ..... G06K 9/00234 382/103
8,494,189 B2 7/2013 Katayama
8,929,572 B2 1/2015 Kim et al.
2007/0025555 A1 2/2007 Gonai et al.
2007/0127730 A1 6/2007 Kim et al.
2007/0269061 A1 * 11/2007 Kim ..... H04S 7/303 381/303
2008/0025534 A1 * 1/2008 Kuhn ..... H04S 7/30 381/300
2008/0159571 A1 * 7/2008 Hooley ..... H04R 1/403 381/307
2008/0232608 A1 9/2008 Ullmann
2008/0273721 A1 11/2008 Walsh
2010/0226499 A1 * 9/2010 De Bruijn ..... H04R 1/403 381/17
2010/0329489 A1 * 12/2010 Karaoguz ..... H04S 7/302 381/307
2011/0038496 A1 * 2/2011 Lott ..... H04R 5/033 381/309
2011/0103620 A1 * 5/2011 Strauss ..... H04S 3/00 381/150
2011/0268281 A1 * 11/2011 Florencio ..... H04S 1/007 381/26
2012/0001875 A1 1/2012 Li et al.
2012/0207322 A1 8/2012 Burnett
2012/0288124 A1 11/2012 Fejzo et al.
2012/0316456 A1 * 12/2012 Rahman ..... G06F 1/163 600/547
2013/0121515 A1 * 5/2013 Hooley ..... H04R 1/403 381/307
2013/0129103 A1 * 5/2013 Donaldson ..... G10K 11/16 381/17.1
2014/0064526 A1 * 3/2014 Otto ..... H04S 5/00 381/300
2014/0136981 A1 5/2014 Xiang et al.
2014/0270187 A1 9/2014 Hall et al.
2015/0036848 A1 2/2015 Donaldson
2015/0264503 A1 9/2015 Hall et al.

FOREIGN PATENT DOCUMENTS

WO 2014145991 A2 9/2014
WO 2014146015 A2 9/2014

OTHER PUBLICATIONS

Thomas, Shane, International Searching Authority, Notification of Transmittal of the International Search Report and the Written Opinion of the International Searching Authority, or the Declaration, dated Sep. 15, 2014 for International Patent Application No. PCT/US14/29840.
Thomas, Shane, International Searching Authority, Notification of Transmittal of the International Search Report and the Written Opinion of the International Searching Authority, or the Declaration, dated Oct. 7, 2014 for International Patent Application No. PCT/US14/30858.
Blouin, Mark S., Non-Final Office Action dated Sep. 25, 2015 for U.S. Appl. No. 14/209,959.
Bernardi, Brenda C., Non-Final Office Action dated Sep. 18, 2015 for U.S. Appl. No. 14/215,047.
Bernardi, Brenda C., Non-Final Office Action dated Feb. 5, 2016 for U.S. Appl. No. 14/215,047.

* cited by examiner

SPATIAL AUDIO AGGREGATION FOR MULTIPLE SOURCES OF SPATIAL AUDIO

CROSS-REFERENCE TO RELATED APPLICATIONS

This application is a U.S. non-provisional patent application that claims the benefit of U.S. Provisional Patent Application No. 61/786,445, filed Mar. 15, 2013, and entitled "LISTENING OPTIMIZATION FOR CROSS-TALK CANCELLED AUDIO," which is herein incorporated by reference for all purposes.

FIELD

Various embodiments relate generally to electrical and electronic hardware, computer software, wired and wireless network communications, and audio and speaker systems. More specifically, disclosed are an apparatus and a method for processing signals for optimizing audio, such as 3D audio, by adjusting the filtering for cross-talk cancellation based on listener position and/or orientation.

BACKGROUND

Listeners that consume conventional stereo audio typically experience the unpleasant phenomena of "crosstalk," which occurs when sound for one channel is received by both ears of the listener. In the generation of three-dimensional ("3D") audio, crosstalk further destroys the sounds that the listener receives. Thus, minimizing crosstalk in 3D audio has been more challenging to resolve. One approach to resolving crosstalk for 3D sound is the use of a filter that provides for crosstalk cancellation. One such filter is a BACCH® Filter of Princeton University.

While functional, conventional filters to cancel crosstalk in audio are not well-suited to address issues that arise in the practical application of such crosstalk cancellation. A typical crosstalk cancellation filter, especially those designed for a dipole speaker, provide for a relatively narrow angular listening "sweet spot," outside of which the effectiveness of the crosstalk cancellation filter decreases. Outside of this "sweet spot," a listener can perceive a reduction in the spatial dimension of the audio. Further, head rotations can reduce the level crosstalk cancellation achieved at the ears of the listener. Moreover, due to room reflections and ambient noise, crosstalk cancellation techniques achieved at the ears of the listener may not be sufficient to provide a full 360° range of spatial effects that can be provided by a dipole speaker.

Thus, what is needed is a solution without the limitations of conventional techniques.

BRIEF DESCRIPTION OF THE DRAWINGS

Various embodiments or examples ("examples") of the invention are disclosed in the following detailed description and the accompanying drawings.

DETAILED DESCRIPTION

Various embodiments or examples may be implemented in numerous ways, including as a system, a process, an apparatus, a user interface, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1:
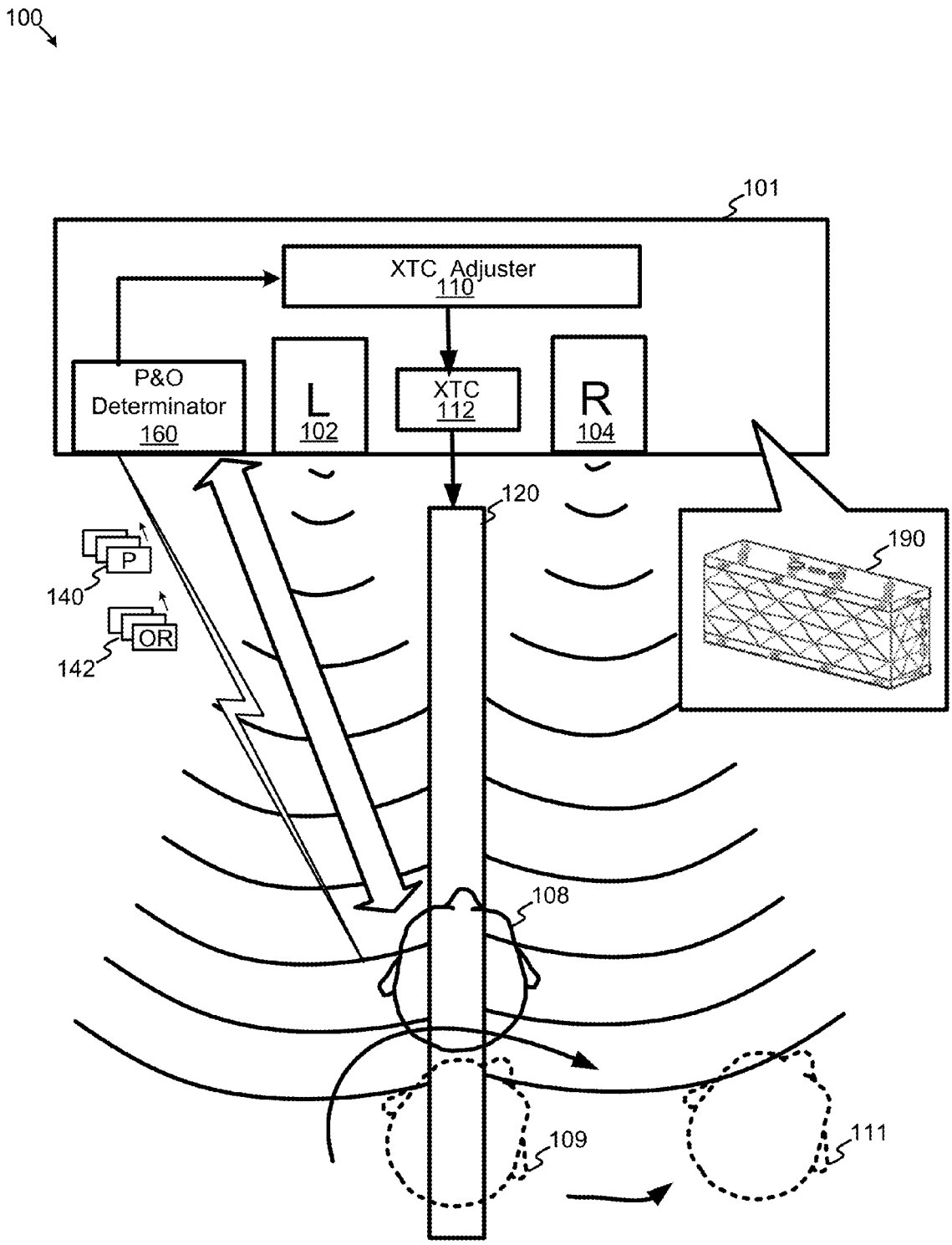
FIG. 1 illustrates an example of a crosstalk adjuster, according to some embodiments.

FIG. 1 illustrates an example of a crosstalk adjuster, according to some embodiments. Diagram 100 depicts an audio device 101 that includes one or more transducers configured to provide a first channel ("L") 102 of audio and one or more transducers configured to provide a second channel ("R") 104 of audio. In some embodiments, audio device 101 can be configured as a dipole speaker that includes, for example, two to four transducers to carry two (2) audio channels, such as the left channel and a right channel. In implementations with four transducers, a channel may be split into frequency bands and reproduced with separate transducers. In at least one example, audio device 101 can be implemented based on a Big Jambox 190, which is manufactured by Jawbone®, Inc.

As shown, audio device 101 further includes a crosstalk filter ("XTC") 112, a crosstalk adjuster ("XTC adjuster") 110, and a position and orientation ("P&O") determinator 160. Crosstalk filter 112 is configured to generate filter 120 which is configured to isolate the right ear of listener 108 from audio originating from channel 102 and further configured to isolate the left ear of listener 108 from audio originating from channel 104. But in certain cases, listener 108 invariably will move its head, such as depicted in FIG. 1 as listener 109. P&O determinator 160 is configured to detect a change in the orientation of the ears of listener 109 so that crosstalk adjuster 110 can compensate for such an orientation change by providing updated filter parameters to crosstalk filter 112. In response, crosstalk filter 112 is configured to change a spatial location at which the crosstalk is effectively canceled to another spatial location to ensure listener 109 remains with in a space of effective crosstalk cancellation. P&O determinator 160 is also configured to detect a change in position of the ears of listener 111. In response to the change in position, as detected by P&O determinator 160, crosstalk adjuster 110 is configured to generate filter parameters to compensate for the change in position, and is further configured to provide those parameters to crosstalk filter 112.

According to some embodiments, P&O determinator 160 is configured to receive position data 140 and orientation 142 from one or more devices associated listener 108. Or, in other examples, P&O determinator 160 is configured to internally determine at least a portion of position data 140 and at least a portion of orientation data 142.

Figure 2:
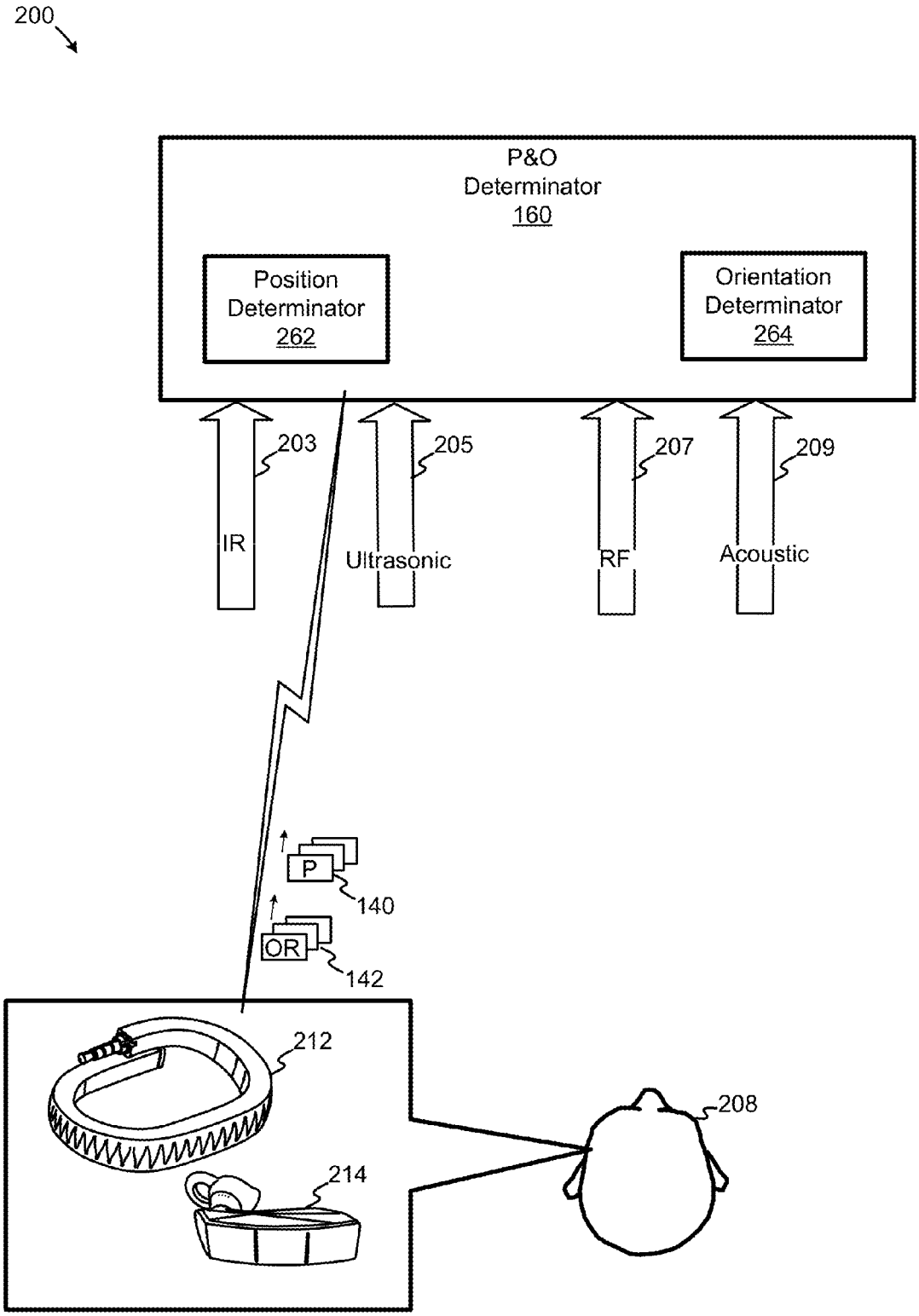
FIG. 2 is a diagram depicting an example of a position and orientation determinator, according to some embodiments.

FIG. 2 is a diagram depicting an example of P&O determinator 160, according to some embodiments. Diagram 200 depicts P&O determinator 160 including a position determinator 262 and an orientation determinator 264, according to at least some embodiments. Position determinator 262 is configured to determine the position of listener 208 in a variety of ways. The first example, position determinator 262 can detect an approximate position of listener 208 using optical and/or infrared imaging and related infrared signals 203. In a second example, position determinator 262 can detect of an approximate position of listener 208 using ultrasonic energy 205 to scan for occupants in a room, as well as approximate locations thereof. In a third example, position determinator 262 can use radio frequency ("RF") signals 207 emanating from devices that emit one or more RF frequencies, when in use or when idle (e.g., in ping mode with, for example, a cell tower). In the fourth example, position determinator 262 can be configured to determine approximate location of listener 208 using acoustic energy 209. Alternatively, position determinator 262 can receive position data 140 from wearable devices such as, a wearable data-capable band 212 or a headset 214, both of which can communicate via a wireless communications path, such as a Bluetooth® communications link.

According to some embodiments, orientation determinator 264 can determine the orientation of, for example, the head and the ears of listener 208. Orientation determinator 264 can also determine the orientation of user 208 by using for example MEMS-based gyroscopes or magnetometers disposed, for example, in wearable devices 212 or 214. In some cases, video tracking techniques and image recognition may be used to determine the orientation of user 208.

Figure 3:
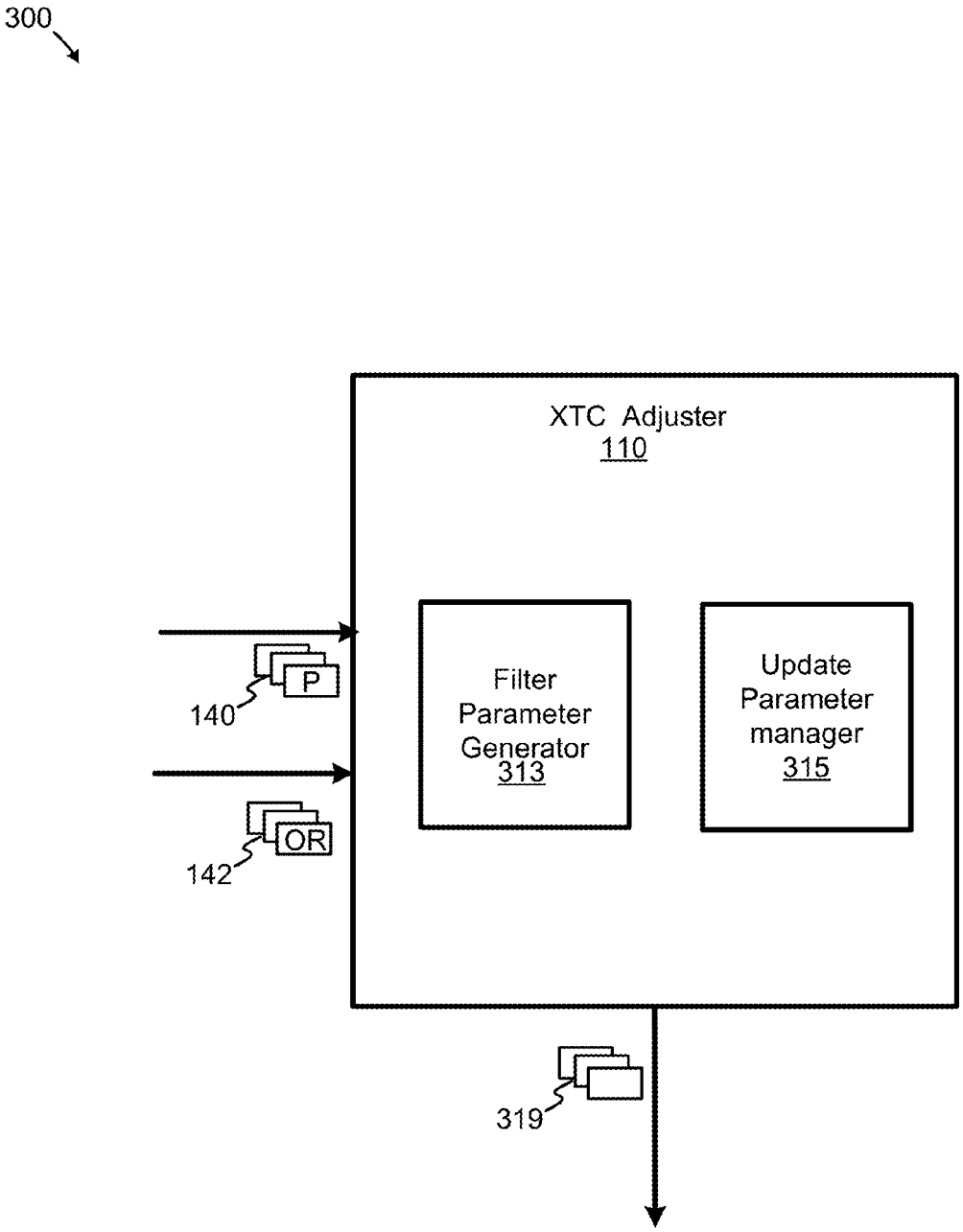
FIG. 3 is a diagram depicting a crosstalk cancellation filter adjuster, according to some embodiments.

FIG. 3 is a diagram depicting a crosstalk cancellation filter adjuster, according to some embodiments. Diagram 300 depicts a crosstalk cancellation filter adjuster 110 including a filter parameter generator 313 and an update parameter manager 315. Crosstalk cancellation filter adjuster 110 is configured to receive position data 140 and orientation data 142. Filter parameter generator 313 uses position data 140 and orientation data 142 to calculate an appropriate angle, distance and/or orientation with which to use as control data 319 to control the operation of crosstalk filter 112 of FIG. 1 Update parameter manager 315 is configured to dynamically monitor the position of the listener at a sufficient frame rate, such as at (e.g., 30 fps) if using video, and correspondingly activate filter parameter generator 313 to generate update data configure to change operation of the crosstalk filter as an update.

Figure 4:
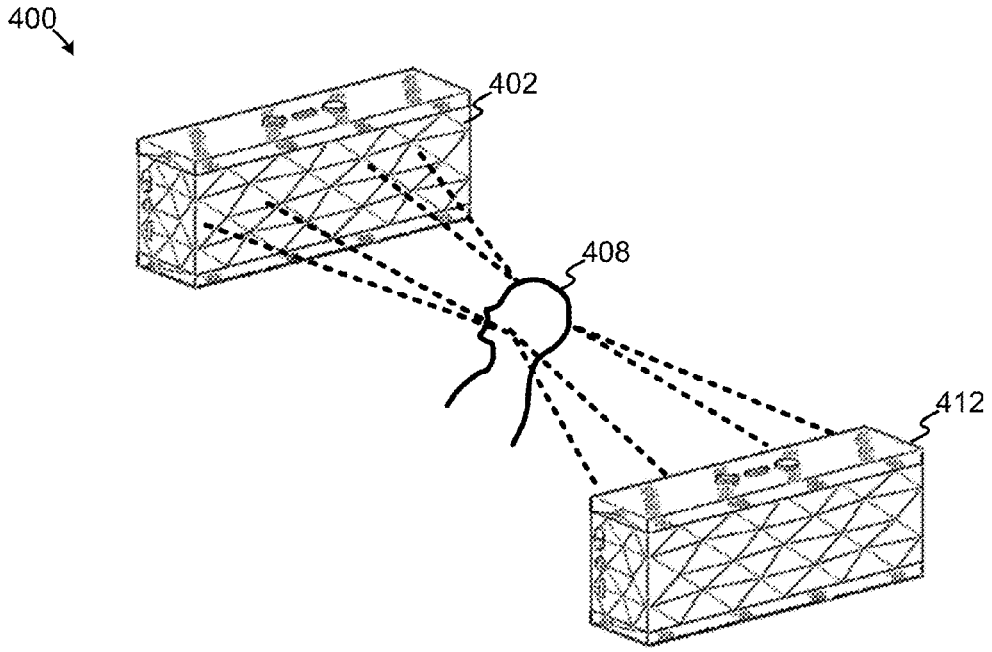
FIG. 4 depicts an implementation of multiple audio devices, according to some examples.

FIG. 4 depicts an implementation of multiple audio devices, according to some examples. Diagram 400 depicts a first audio device 402 and a second audio device 412 being configured to enhance the accuracy of 3D spatial perception of sound in the rear 180 degrees. Each of first audio device 402 and a second audio device 412 is configured to track the listener 408 independently. Greater rear externalization of spatial sound can be achieved by disposing audio device 412 behind listener 408 when audio device 402 is substantially in front of listener 408. In some cases, first audio device 402 and a second audio device 412 are configured to communicate such that only one of the first audio device 402 and a second audio device 412 need determine the position and/or orientation of listener 408.

Figure 5:
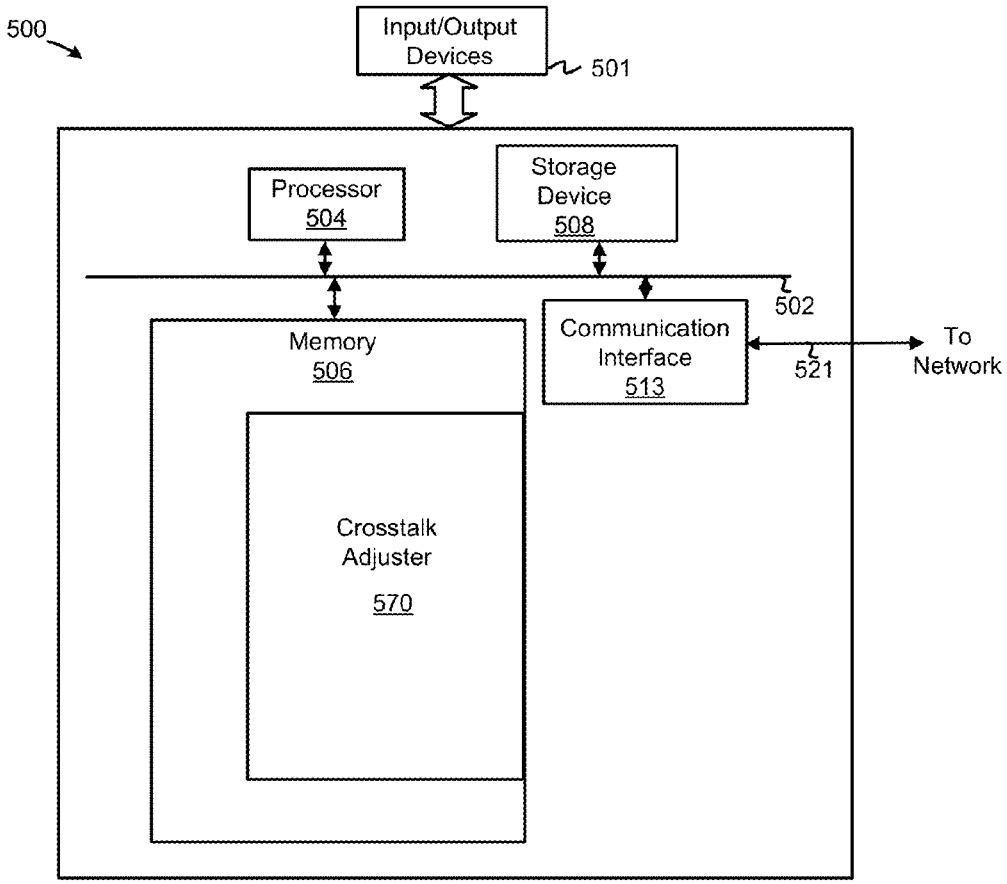
FIG. 5 illustrates an exemplary computing platform disposed in a configured to provide adjustment of a crosstalk cancellation filter in accordance with various embodiments.

FIG. 5 illustrates an exemplary computing platform disposed in a configuration to provide adjustment of a crosstalk cancellation filter in accordance with various embodiments. In some examples, computing platform 500 may be used to implement computer programs, applications, methods, processes, algorithms, or other software to perform the above-described techniques.

In some cases, computing platform can be disposed in an ear-related device/implement, a mobile computing device, or any other device.

Computing platform 500 includes a bus 502 or other communication mechanism for communicating information, which interconnects subsystems and devices, such as processor 504, system memory 506 (e.g., RAM, etc.), storage device 505 (e.g., ROM, etc.), a communication interface 513 (e.g., an Ethernet or wireless controller, a Bluetooth controller, etc.) to facilitate communications via a port on communication link 521 to communicate, for example, with a computing device, including mobile computing and/or communication devices with processors. Processor 504 can be implemented with one or more central processing units ("CPUs"), such as those manufactured by Intel® Corporation, or one or more virtual processors, as well as any combination of CPUs and virtual processors. Computing platform 500 exchanges data representing inputs and outputs via input-and-output devices 501, including, but not limited to, keyboards, mice, audio inputs (e.g., speech-to-text devices), user interfaces, displays, monitors, cursors, touch-sensitive displays, LCD or LED displays, and other I/O-related devices.

According to some examples, computing platform 500 performs specific operations by processor 504 executing one or more sequences of one or more instructions stored in system memory 506, and computing platform 500 can be implemented in a client-server arrangement, peer-to-peer arrangement, or as any mobile computing device, including smart phones and the like. Such instructions or data may be read into system memory 506 from another computer readable medium, such as storage device 508. In some examples, hard-wired circuitry may be used in place of or in combination with software instructions for implementation. Instructions may be embedded in software or firmware. The term "computer readable medium" refers to any tangible medium that participates in providing instructions to processor 504 for execution. Such a medium may take many forms, including but not limited to, non-volatile media and volatile media. Non-volatile media includes, for example, optical or magnetic disks and the like. Volatile media includes dynamic memory, such as system memory 506.

Common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, or any other medium from which a computer can read. Instructions may further be transmitted or received using a transmission medium. The term "transmission medium" may include any tangible or intangible medium that is capable of storing, encoding or carrying instructions for execution by the machine, and includes digital or analog communications signals or other intangible medium to facilitate communication of such instructions. Transmission media includes coaxial cables, copper wire, and fiber optics, including wires that comprise bus 502 for transmitting a computer data signal.

In some examples, execution of the sequences of instructions may be performed by computing platform 500. According to some examples, computing platform 500 can be coupled by communication link 521 (e.g., a wired network, such as LAN, PSTN, or any wireless network) to any other processor to perform the sequence of instructions in coordination with (or asynchronous to) one another. Computing platform 500 may transmit and receive messages, data, and instructions, including program code (e.g., application code) through communication link 521 and communication interface 513. Received program code may be executed by processor 504 as it is received, and/or stored in memory 506 or other non-volatile storage for later execution.

In the example shown, system memory 506 can include various modules that include executable instructions to implement functionalities described herein. In the example shown, system memory 506 includes a crosstalk cancellation filter adjuster 570, which can be configured to provide or consume outputs from one or more functions described herein.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques. As hardware and/or firmware, the above-described techniques may be implemented using various types of programming or integrated circuit design languages, including hardware description languages, such as any register transfer language ("RTL") configured to design field-programmable gate arrays ("FPGAs"), application-specific integrated circuits ("ASICs"), or any other type of integrated circuit. According to some embodiments, the term "module" can refer, for example, to an algorithm or a portion thereof, and/or logic implemented in either hardware circuitry or software, or a combination thereof. These can be varied and are not limited to the examples or descriptions provided.

In some embodiments, an audio device implementing a cross-talk filter adjuster can be in communication (e.g., wired or wirelessly) with a mobile device, such as a mobile phone or computing device, or can be disposed therein. In some cases, a mobile device, or any networked computing device (not shown) in communication with an audio device implementing a cross-talk filter adjuster can provide at least some of the structures and/or functions of any of the features described herein. As depicted in FIG. 1 and subsequent figures, the structures and/or functions of any of the above-described features can be implemented in software, hardware, firmware, circuitry, or any combination thereof. Note that the structures and constituent elements above, as well as their functionality, may be aggregated or combined with one or more other structures or elements. Alternatively, the elements and their functionality may be subdivided into constituent sub-elements, if any. As software, at least some of the above-described techniques may be implemented using various types of programming or formatting languages, frameworks, syntax, applications, protocols, objects, or techniques. For example, at least one of the elements depicted in any of the figure can represent one or more algorithms. Or, at least one of the elements can represent a portion of logic including a portion of hardware configured to provide constituent structures and/or functionalities.

For example, an audio device implementing a cross-talk filter adjuster, or any of their one or more components can be implemented in one or more computing devices (i.e., any mobile computing device, such as a wearable device, an audio device (such as headphones or a headset) or mobile phone, whether worn or carried) that include one or more processors configured to execute one or more algorithms in memory. Thus, at least some of the elements in FIG. 1 (or any subsequent figure) can represent one or more algorithms. Or, at least one of the elements can represent a portion of logic including a portion of hardware configured to provide constituent structures and/or functionalities. These can be varied and are not limited to the examples or descriptions provided.

As hardware and/or firmware, the above-described structures and techniques can be implemented using various types of programming or integrated circuit design languages, including hardware description languages, such as any register transfer language ("RTL") configured to design field-programmable gate arrays ("FPGAs"), application-specific integrated circuits ("ASICs"), multi-chip modules, or any other type of integrated circuit. For example, an audio device implementing a cross-talk filter adjuster, including one or more components, can be implemented in one or more computing devices that include one or more circuits.

Thus, at least one of the elements in FIG. 1 (or any subsequent figure) can represent one or more components of hardware. Or, at least one of the elements can represent a portion of logic including a portion of circuit configured to provide constituent structures and/or functionalities.

According to some embodiments, the term "circuit" can refer, for example, to any system including a number of components through which current flows to perform one or more functions, the components including discrete and complex components. Examples of discrete components include transistors, resistors, capacitors, inductors, diodes, and the like, and examples of complex components include memory, processors, analog circuits, digital circuits, and the like, including field-programmable gate arrays ("FPGAs"), application-specific integrated circuits ("ASICs"). Therefore, a circuit can include a system of electronic components and logic components (e.g., logic configured to execute instructions, such that a group of executable instructions of an algorithm, for example, and, thus, is a component of a circuit). According to some embodiments, the term "module" can refer, for example, to an algorithm or a portion thereof, and/or logic implemented in either hardware circuitry or software, or a combination thereof (i.e., a module can be implemented as a circuit). In some embodiments, algorithms and/or the memory in which the algorithms are stored are "components" of a circuit. Thus, the term "circuit" can also refer, for example, to a system of components, including algorithms. These can be varied and are not limited to the examples or descriptions provided.

Figure 6:
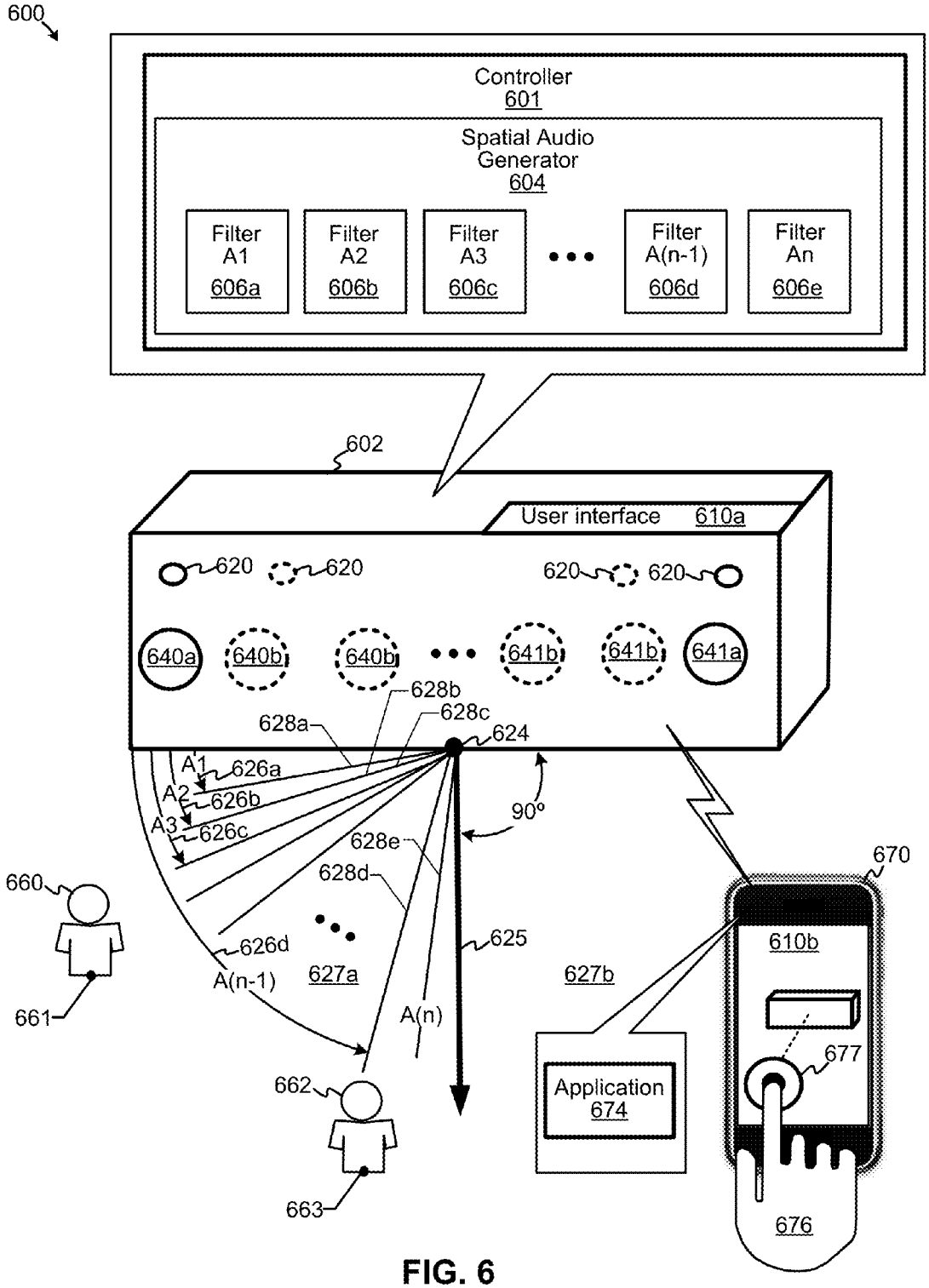
FIG. 6 is a diagram depicting a media device implementing a number of filters configured to deliver spatial audio, according to some embodiments.

FIG. 6 is a diagram depicting a media device implementing a number of filters configured to deliver spatial audio, according to some embodiments. Diagram 600 depicts a media device 602 including a controller 601, which, in turn, includes a spatial audio generator 604 configured to generate audio. Media device 602 can generate audio or receive data representing spatial audio (e.g., 2-D or 3-D audio) and/or binaural audio signals, stereo audio signals, monaural audio signals, and the like. Thus, spatial audio generator 604 of media device 602 can generate acoustic signals as spatial audio, which can form an impression or a perception at the ears of a listener that sounds are coming from audio sources that are perceived to be disposed/positioned in a region (e.g., 2D or 3D space) that includes recipient 660, rather than being perceived as originating from locations of two or more loudspeakers in the media device 602.

Diagram 600 also depicts media device 602 including an array of transducers, including transducers 640*a*, 641*a*, 640*b*, and 641*b*. In some examples, transducers 640 can constitute a first channel, such as a left channel of audio, whereas transducers 641 can constitute a second channel, such as a right channel of audio. In at least one example, a single transducer 640*a* can constitute a left channel and a single transducer 641*a* can constitute a right channel. In various embodiments, however, any number of transducers can be implemented. Also, transducers 640*a* and 641*a* can be implemented as woofers or subwoofers, and transducers 640*b* and 641*b* can be implemented as tweeters, among other various configurations. Further, one or more subsets of transducers 640*a*, 641*a*, 640*b*, and 641*b* can be configured to steer the same or different spatial audio to listener 660 at a first position and to listener 662 and a second position. Media device 602 also includes microphones 620. Various examples of microphones that can be implemented as microphones 620, which include directional microphones, omnidirectional microphones, cardioid microphones, Blumlein microphones, ORTF stereo microphones, binaural microphones, arrangements of microphones (e.g., similar to Neumann KU 100 binaural microphones or the like), and other types of microphones or microphone systems.

Further to FIG. 6, diagram 600 depicts a bank of filters 606 each configured to implement a spatial audio filter configured to project spatial audio to a position, such as positions 661 or 663, in a region in space adjacent to media device 602. In some examples, controller 601 is configured to determine a position 661 and 663 as a function of, for example, an angle relative to media device 602, an orientation of a listeners head and ears, a distance between the position and media device 602, and the like. Based on a position, controller 601 can cause a specific spatial audio filter to be implemented so that spatial audio may be projected to, for example, listener 660 at position 661. The selected spatial audio filter may be applied to at least two channels of an audio stream that is to be presented to a listener.

In the example shown, each spatial audio filter 606 is configured to project spatial audio to a corresponding position. For example, spatial audio filter ("A1") 606*a* is configured to project spatial audio to a position along direction 628*a* at an angle ("A1") 626*a* relative to either to a plane passing through one or more transducers (e.g., a front surface) or a reference line 625, which emanates from reference point 624. Further, spatial audio filter ("A2") 606*b*, spatial audio filter ("A3") 606*c*, and spatial audio filter ("A(n−1)") 606*d* are configured to project spatial audio to a position along direction 628*b* at an angle ("A2") 626*b*, direction 628*c* at an angle ("A3") 626*c*, and direction 628*d* at an angle ("A(n−1)") 626*d*, respectively. According to various embodiments, any number of filters can be implemented to project spatial audio to any number of positions or angles associated with media device 602. In at least one example, quadrant 627*a* (e.g., the region to the left of reference line 625) can be subdivided into at least 20 sectors with which a line and an angle can be associated. Thus, 20 filters can be implemented to provide spatial audio to at least 20 positions in quadrant 627*a* (e.g., spatial audio filter 606*e* can be the twentieth filter). In some embodiments, filters 606*a* to 606*e* can be used to project spatial audio to positions in quadrant 627*b* as this quadrant is symmetric to quadrant 627*a*.

In accordance with diagram 600, a position can be determined via user interface 610*a* when a listener enters, as a user input, a position at which listener is located. For example, the user can select one of 20 positions/angles via user interface 610*a* for receiving spatial audio. In another example, the user can provide a position via an application 674 implemented in a mobile computing device 670. For example, mobile computing device 610 can generate user interface 610*b* depicting a representation of media device 602 and one of a number of positions at which the listener may be situated. Thus, a user 662 can provide user input 676 via user interface 610*b* to select a position specified by icon 677. According to some embodiments, a user may enter another position when the user changes position relative to media device 602. Further to this example, controller 601 can be configured to generate a first channel of the spatial audio, such as a left channel of spatial audio, and a second channel of spatial audio, such as a right channel. A first subset of transducers 640 and 641 of media device 602 can propagate the first channel of the spatial audio into the region in space, whereas a second subset of transducers 640 and 641 can propagate the second channel of the spatial audio into the region in space. Further, the first and second subset of transducers can steer audio projection to position 663, whereas listener 660 at position 661 need not have the ability to perceive the audio. In some instances, listener 660 can select another filter, such as filter 606*c*, with which to receive spatial audio by propagating the spatial audio from a third and a fourth subset of transducers. Thus, a listener 660 and 662 (at different corresponding positions) can use different filters to receive the same or different spatial audio over different paths.

As an example, controller 601 can generate spatial audio using a subset of spatial audio generation techniques that implement digital signal processors, digital filters 606, and the like, to provide perceptible cues for recipients 660 and 662 to correlate spatial audio relative to perceived positions from which the audio originate. In some embodiments, controller 601 is configured to implement a crosstalk cancellation filter (and corresponding filter parameters), or variant thereof, as disclosed in published international patent application WO2012/036912A1, which describes an approach to producing cross-talk cancellation filters to facilitate three-dimensional binaural audio reproduction. In some examples, controller 601 includes one or more digital processors and/or one or more digital filters configured to implement a BACCH® digital filter, an audio technology developed by Princeton University of Princeton, N.J. In some examples, controller 601 includes one or more digital processors and/or one or more digital filters configured to implement LiveAudio® as developed by AliphCom of San Francisco, Calif. Note that spatial audio generator 604 is not limited to the foregoing.

Figure 7:
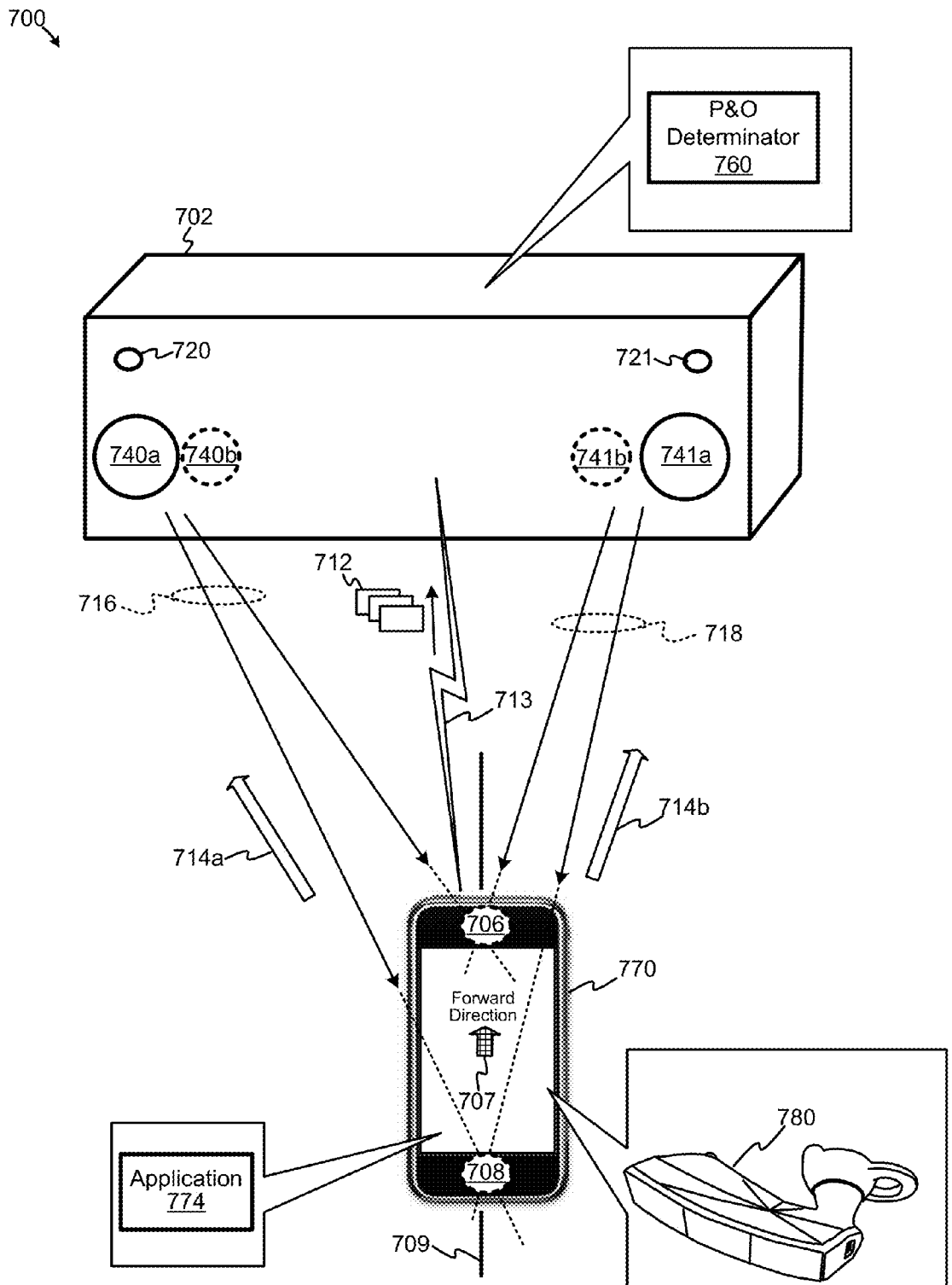
FIG. 7 depicts a diagram illustrating an example of using probe signals to determine a position, according to some embodiments.

FIG. 7 depicts a diagram illustrating an example of using probe signals to determine a position, according to some embodiments. Diagram 700 depicts a media device 702 including a position and orientation ("P&O") determinator 760 that is configured to determine either a position of the user (or a user's mobile computing device 770) or an orientation of the user, or both. Media device 702 also includes a first microphone 720 (e.g., disposed at a left side) and a second microphone 721 (e.g., disposed at the right side). Further, media device 702 includes one or more transducers 740 as a left channel and one or more transducers 741 as a right channel. Position determinator 760 can be configured to calculate the delays of a sound received among a subset of microphones relative to each other to determine a point (or an approximate point) from which the sound originates. Delays can represent farther distances a sound travels before being received by a microphone. By comparing delays and determining the magnitudes of such delays, in, for example, an array of transducers operable as microphones, the approximate point from which the sound originates can be determined. In some embodiments, position determinator 760 can be configured to determine the source of sound by using known time-of-flight and/or triangulation techniques and/or algorithms As shown, mobile computing device 770 includes an application 774 having executable instructions to access a number of microphones 706 and 708, among others, to receive acoustic probe signals 716 and 718 from media device 702. Media device 702 may generate acoustic probe signals 716 and 718 as unique probe signals so that application 774 can uniquely identify which transducer (or portion of media device 702) emitted a probe signal. Acoustic probe signals 716 and 718 can be audible or ultrasonic, and can include different data (e.g., different transducer identifiers), can differ by frequency or any other signal characteristic, etc. In a listening mode, application 774 is configured to detect a first acoustic probe signal 716 at, for example, microphone 706 and microphone 708. Application 774 can identify acoustic probe signal 716 by signal characteristics, and can determine relative distances between transducers 740 and microphones 706 and 708 based, for example, time-of-flight or the like. Similarly, application 774 is configured to detect a second acoustic probe signal 718 at the same microphones. In one example, application 774 determines a relative position of mobile device 770 relative to transducer 740 and 741, and transmits data 712 representing the relative position via communications link 713 (e.g., a Bluetooth link). Alternatively, application 774 can cause mobile device 770 to emit one or more acoustic signals 714*a* and 714*b* to provide additional information to position and orientation determinator 760 to enhance accuracy of an estimated position.

In one example, application 774 can cause presentation of a visual icon 707 to request the user position mobile device 770 in a direction shown. Icon 707 facilitates an alignment of mobile device 770 in a direction through which a median line 709 passes through microphones 706 and 708. As a user generally faces a direction depicted by icon 707, alignment of mobile device 770 can be presumed, whereby an orientation of the listener's ears can be presumed to be oriented toward media device 702 (e.g., the pinnae are facing media device 702). In some examples, mobile computing device 770 can be implemented by a variety of different devices, including headset 780 and the like.

Figure 8:
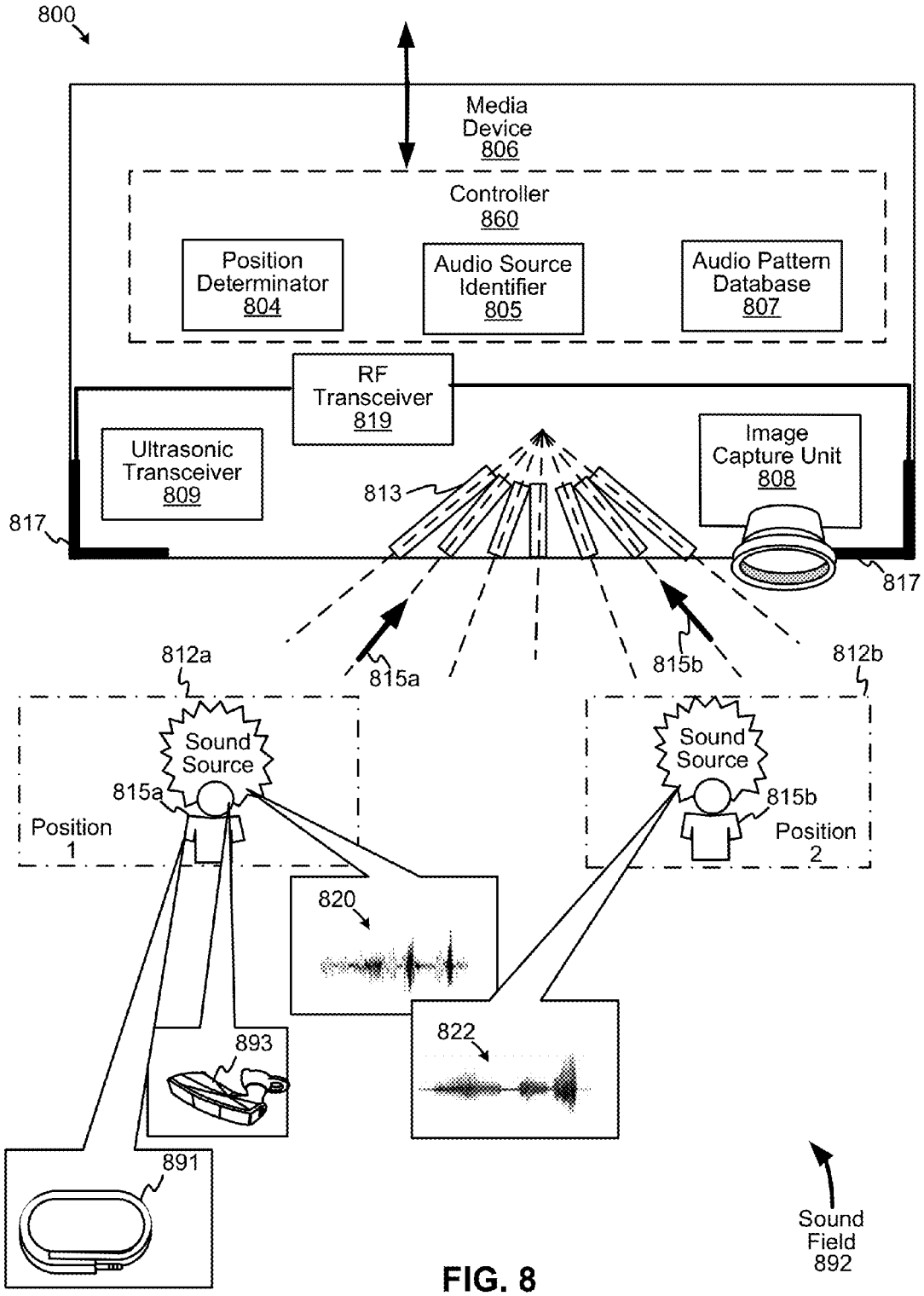
FIG. 8 depicts an example of a media device including a controller configured to determine position data and/or identification data regarding one or more audio sources, according to some embodiments.

FIG. 8 depicts an example of a media device including a controller configured to determine position data and/or identification data regarding one or more audio sources, according to some embodiments. In this example, diagram 800 depicts a media device 806 including a controller 860, an ultrasonic transceiver 809, an array of microphones 813, a radio frequency ("RF") transceiver 819 coupled to antennae 817 capable of determining position, and an image capture unit 808, any of which may be optional. Controller 860 is shown to include a position determinator 804, an audio source identifier 805, and an audio pattern database 807. Position determinator 804 is configured to determine a position 812*a* of an audio source 815*a*, and a position 812*b* of an audio source 815*b* relative to, for example, a reference point coextensive with media device 806. In some embodiments, position determinator 804 is configured to receive position data from a wearable device 891 which may include a geo-locational sensor (e.g., a GPS sensor) or any other position or location-like sensor. An example of a suitable wearable device, or a variant thereof, is described in U.S. patent application Ser. No. 13/454,040, which is incorporated herein by reference. Another example of a wearable device is headset 893. In other examples, position determinator 804 can implement one or more of ultrasonic transceiver 809, array of microphones 813, RF transceiver 819, image capture unit 808, etc.

Ultrasonic transceiver 809 can include one or more acoustic probe transducers (e.g., ultrasonic signal transducers) configured to emit ultrasonic signals to probe distances and/or locations relative to one or more audio sources in a sound field. Ultrasonic transceiver 809 can also include one or more ultrasonic acoustic sensors configured to receive reflected acoustic probe signals (e.g., reflected ultrasonic signals). Based on reflected acoustic probe signals (e.g., including the time of flight, or a time delay between transmission of acoustic probe signal and reception of reflected acoustic probe signal), position determinator 804 can determine positions 812*a* and 812*b*. Examples of implementations of one or more portions of ultrasonic transceiver 809 are set forth in U.S. Nonprovisional patent application Ser. No. 13/954,331, filed Jul. 30, 2013, and entitled "Acoustic Detection of Audio Sources to Facilitate Reproduction of Spatial Audio Spaces," and U.S. Nonprovisional patent application Ser. No. 13/954,367, filed Jul. 30, 2013, and entitled "Motion Detection of Audio Sources to Facilitate Reproduction of Spatial Audio Spaces," each of which is herein incorporated by reference in its entirety and for all purposes.

Image capture unit 808 can be implemented as a camera, such as a video camera. In this case, position determinator 804 is configured to analyze imagery captured by image capture unit 808 to identify sources of audio. For example, images can be captured and analyzed using known image recognition techniques to identify an individual as an audio source, and to distinguish between multiple audio sources or orientations (e.g., whether a face or side of head is oriented toward the media device). Based on the relative size of an audio source in one or more captured images, position determinator 804 can determine an estimated distance relative to, for example, image capture unit 808. Further, position determinator 804 can estimate a direction based on the portion in which the audio sources captured relative to the field of view (e.g., potential audio source captured in a right portion of the image can indicate the audio source may be in the direction of approximately 60 to 90° to a normal vector). Further, image capture unit 808 can capture imagery based on any frequency of light including visible light, infrared, and the like.

Microphones (e.g., in array of microphones 813) can each be configured to detect or pick-up sounds originating at a position or a direction. Position determinator 804 can be configured to receive acoustic signals from each of the microphones or directions from which a sound, such as speech, originates. For example, a first microphone can be configured to receive speech originating in a direction 815*a* from a sound source at position 812*a*, whereas a second microphone can be configured to receive sound originating in a direction 815*b* from a sound source at position 812*b*. For example, position determinator 804 can be configured to determine the relative intensities or amplitudes of the sounds received by a subset of microphones and identify the position (e.g., direction) of a sound source based on a corresponding microphone receiving, for example, the greatest amplitude. In some cases, a position can be determined in three-dimensional space. Position determinator 804 can be configured to calculate the delays of a sound received among a subset of microphones relative to each other to determine a point (or an approximate point) from which the sound originates. Delays can represent farther distances a sound travels before being received by a microphone. By comparing delays and determining the magnitudes of such delays, in, for example, an array of transducers operable as microphones, the approximate point from which the sound originates can be determined. In some embodiments, position determinator 804 can be configured to determine the source of sound by using known time-of-flight and/or triangulation techniques and/or algorithms.

Audio source identifier 805 is configured to identify or determine identification of an audio source. In some examples, an identifier specifying the identity of an audio source can be provided via a wireless link from wearable device, such as wearable device 891. According to some other examples, audio source identifier 805 is configured to match vocal waveforms received from sound field 892 against voice-based data patterns in an audio pattern database 807. For example, vocal patterns of speech received by media device 806, such as patterns 820 and 822, can be compared against those patterns stored in audio pattern database 807 to determine the identities audio source 815*a* and 815*b*, respectively, upon detecting a match. By identifying an audio source, controller 860 can transform a position of the specific audio source, for example, based on its identity and other parameters, such as the relationship to recipient of spatial audio.

In some embodiments, RF transceiver 819 can be configured to receive any type of RF signal, including Bluetooth. RF transceiver 819 can determine the general position of an RF signal, for example, based on a signal strength (e.g., RSSI) in a general direction from which the source of RF signals originate. Antennae 817, as shown, are just examples. One or more other portions of antenna 817 can be disposed around the periphery of media device 806 to more accurately or precisely determine an angle from which an RF signal originates. The origination source of a RF signal may coincide with a position of the listener. Any of the above described techniques can be used individually or in combination, and can be implemented with other approaches. Other approaches to orientation position determination include using MEMS-based gyroscopes, magnetometers, and other like sensors.

Figure 9:
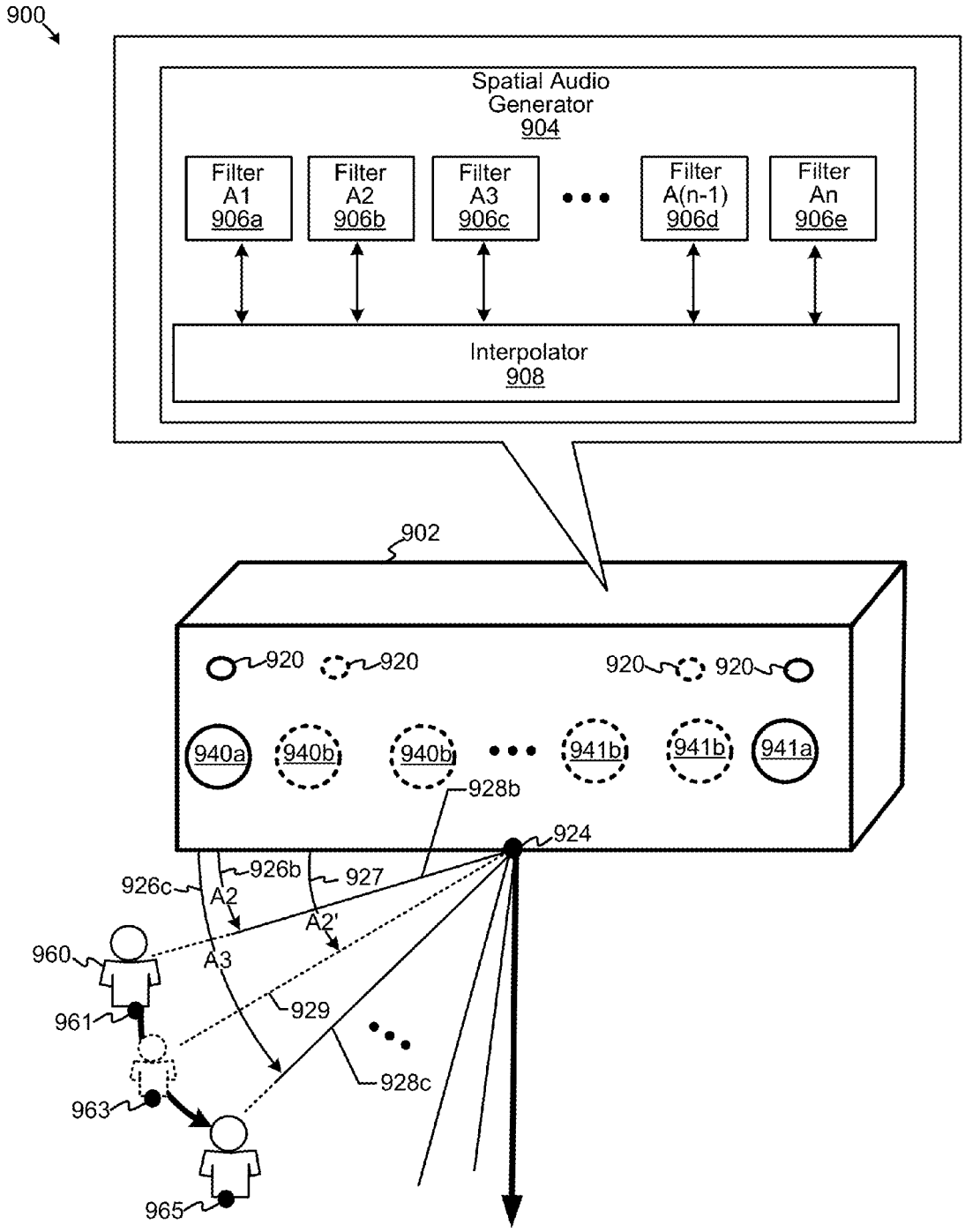
FIG. 9 is a diagram depicting a media device implementing an interpolator, according to some embodiments.

FIG. 9 is a diagram depicting a media device implementing an interpolator, according to some embodiments. Diagram 900 includes a media device 902 having a spatial audio generator 904 configured to generate spatial audio. Further, media device 902 can include a bank of filters 906 and an interpolator 908. Media device 102 includes a number of microphones 920, as well as transducers 940 and transducers 941. Interpolator 908 is configured to assisting transitioning between filters in dynamic cases in which a user 960 moves from a first position in 960 through position 963 to position 965. For example, a position of the listener can be updated at a frame rate of, for instance, 30 fps).

To illustrate operation of an interpolator 908, consider the following example. Listener 960 initially is located at position 961, which is in a direction 928*b* from reference point 924. Direction 928*b* is at an angle ("A2") 926*b* relative to the surface of media device 902. Listener 960 moves from position 961 to position 965, which is located in a direction along line 928*c* at an angle ("A3"). Filter ("A2") 906*b* is configured to project spatial audio to position 961, and filter ("A3") 906*c* is configured to project spatial audio to position 965. In some cases, a filter may be omitted for position 963. Spatial audio generator 904 can be configured to interpret filter parameters based on filter 906*b* and filter 906*c* to project interpolated spatial audio along line 929 at an angle ("A2"). Thus, media device 902 can generate interpolated left and right channels of spatial audio for propagation to position 963 so that listener 960 perceives spatial audio as the listener passes through to position 965. As such, sharp switching between filters and related artifacts may be reduced or avoided. Note that in some cases, the interpolation of filter parameters can be performed in the time or frequency domains, and can be include the application of any operation or transform that provides for a smoother transition between spatial audio filters. In some embodiments, a rate of change can be detected, the rate of change being indicative of the speed at which listener 960 moves between positions. Filter parameters can be interpolated at, or substantially at, the rate of change. For example, smoothing operations and/or transforms can be performed to sufficiently track the listener's position.

Figure 10:
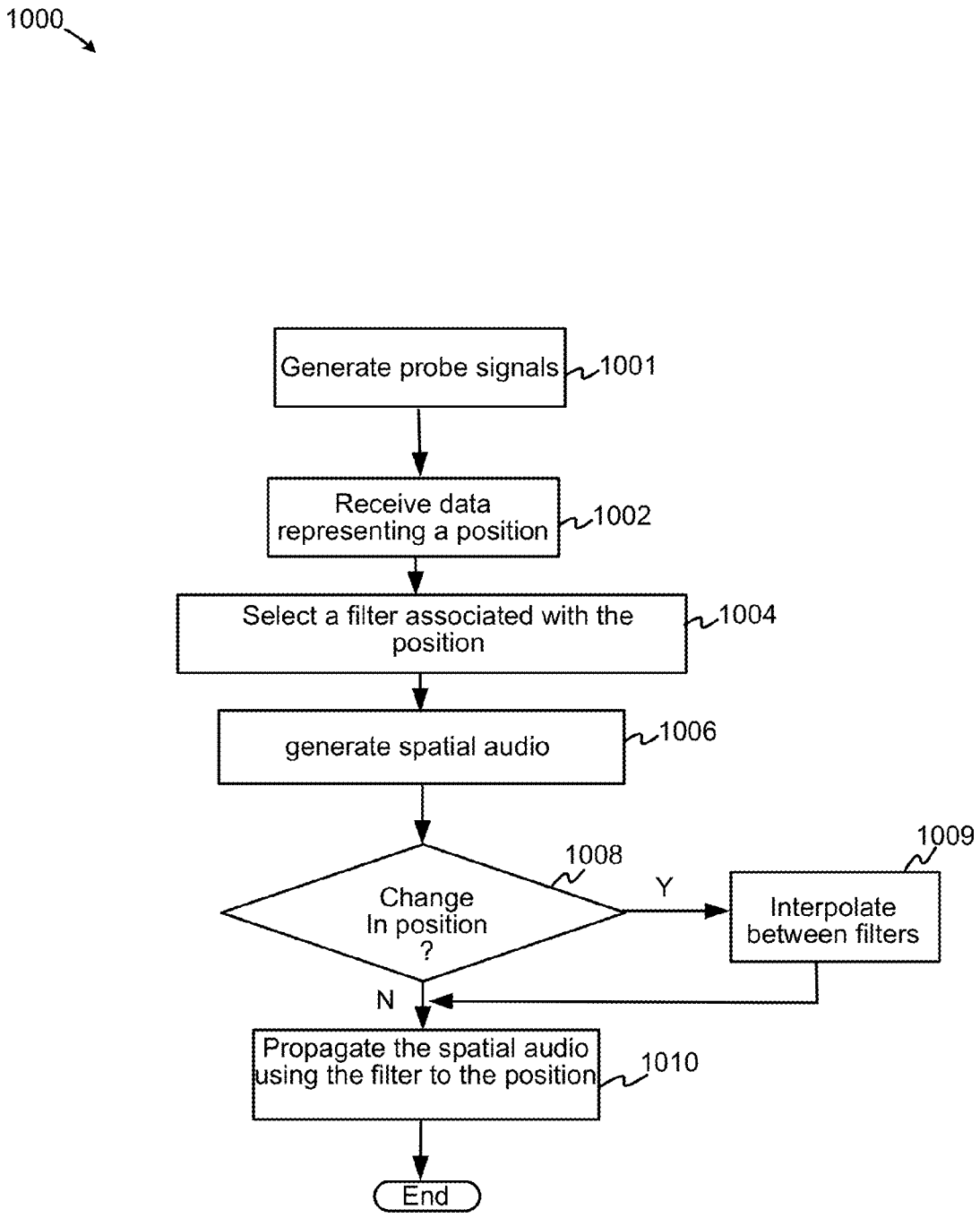
FIG. 10 is an example flow of determining a position in a sound field, according to some embodiments.

FIG. 10 is an example flow of determining a position in a sound field, according to some embodiments. Flow 1000 starts by generating probe signals at 1001, and receiving data representing a position at 1002. At 1004, a filter associated with a position is selected and spatial audio is generated at 1006. A determination is made at 1008 whether a listener's position has changed. If not, spatial audio is propagated using a current filter. If so, flow 1000 proceeds to 1009 at which interpolation can be performed between filters. Flow 1000 returns and continues at 1010. Here, the spatial audio using the interpreted filter characteristics can be propagated to the position at 1010.

Figure 11:
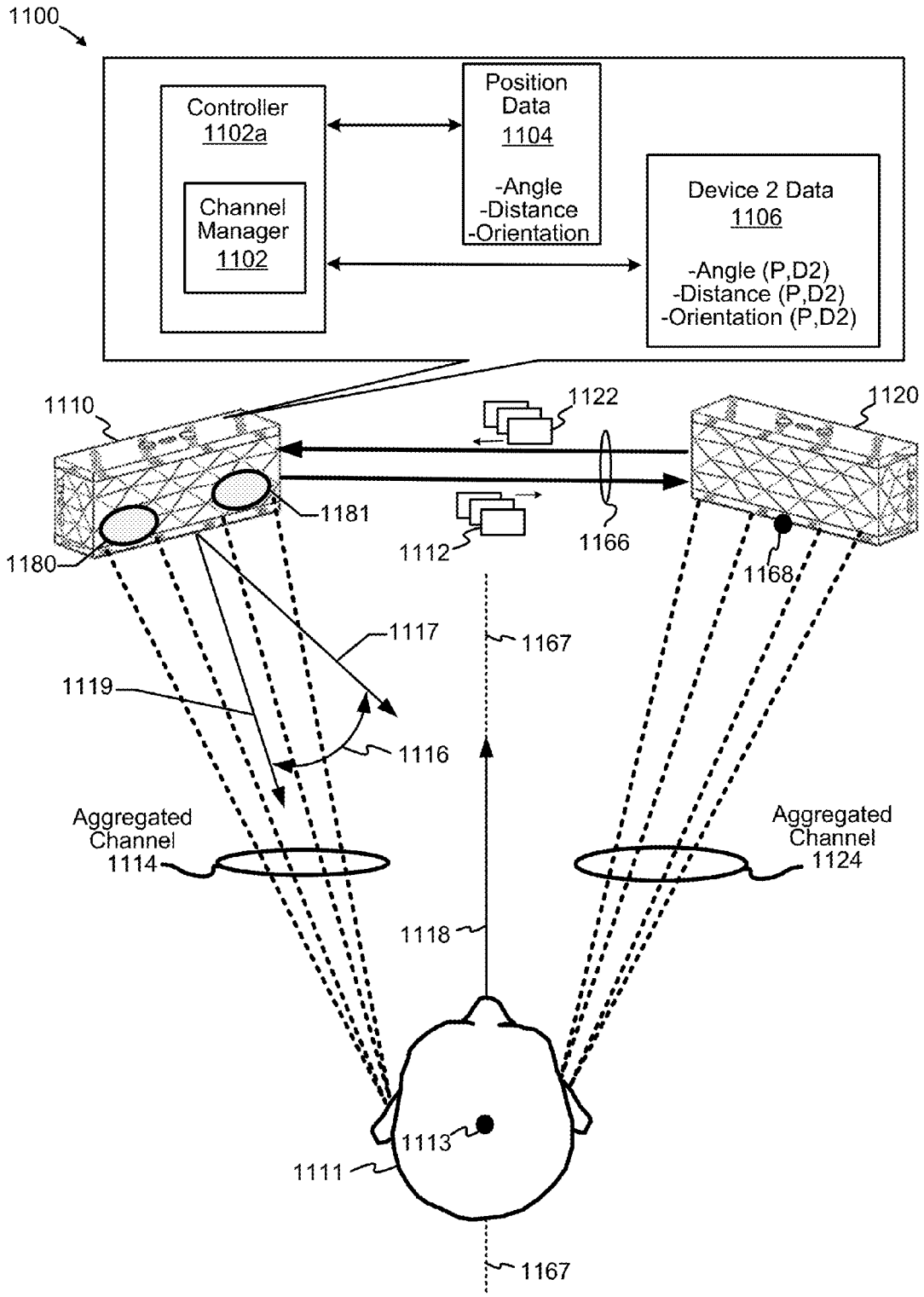
FIG. 11 is a diagram depicting aggregation of spatial audio channels for multiple media devices, according to at least some embodiments.

FIG. 11 is a diagram depicting aggregation of spatial audio channels for multiple media devices, according to at least some embodiments. Diagram 1100 depicts a first media device 1110 and a second media device 1120, one or more being configured to identify a position 1113 of a listener 1111, and to direct spatial audio signals to listener 1111. Position 1113 can be determined in a variety of ways, as described herein. Another example of determining position 1113 is described in FIGS. 12A and 12B. Referring to FIG. 11, diagram 1100 depicts a controller 1102*a* and a channel manager 1102 being disposed in media device 1110. Note that media device 1120 may have similar structures and/or may have similar functionality as media device 1110. As such, media device 1120 may include controller 1102*a* (not shown). Further, diagram 1100 depicts data files 1104 and 1106 including position-related data for position 1113 of listener 1100 and device-related data for media device 1120, respectively. For example, position date 1104 describes an angle 1116 between a reference line 1117 (e.g., orthogonal to a front surface of 1110) and a direction 1119 to position 1113. In this example, listener 1111 is oriented in a direction described by reference line 1118.

According to at least one example, controller 1102*a* is configured to receive data representing position 1113 for a region in space adjacent media device 1110, which includes a subset of transducers 1180 associated with a first channel, and a subset of transducers 1181 associated with a second channel. Controller 1102*a* can also determine media device 1120 adjacent to the region in space, and determining a location of media device 1120. As shown, media devices 1110 and 1120 are configured to establish a communication link 1166 over which data 1122 and 1112 can be exchanged. Communication link 1166 can include an electronic datalink, an acoustic datalink, an optical datalink, electromagnetic datalink, or any other type of datalink over which data can be exchanged. For example, transmitted data 1122 can include device data 1106, such as an angle between position ("P") 1113 and media device ("D2") 1120, a distance between position ("P") 1113 and media device 1120, and an orientation of listener 1111 (e.g., reference line 1118) relative to a reference line (not shown) associated with media device 1120. In some examples, data 1122 can include data representing an angle between a reference line of media device 1120 and media device 1110, the angle specifying a general orientation of the transducers of each of media devices 1120 and 111 each, relative to each other. Note that once receiving data 1122, media device can confirm the presence of another media device adjacent to position 1113.

Media device 1110 can use the data 1122 to confirm the accuracy of its calculation for position 1113, and can take corrective action to improve the accuracy of its calculation. Based on a determination of position 1113 relative to media device 1110, controller 1102*a* may select a filter configured to project spatial audio to a region in space that includes listener 1111. Similarly, media device 1120 can use data 1112 also to confirm its accuracy in calculating position 1113. As such, media device 1120 can select another filter that is appropriate for projecting spatial audio to position 1113.

Further, data 1122 can include data representing a location of media device 1120 (e.g., a location relative to either media device 1110 or position 1113, or both). In some examples, media device 1110 can determine that location 1168 of media device 1120 is disposed on a different side of plane 1167, which, at least in this case, coincides with a direction of reference line 1118. In this case, media device 1120 is disposed adjacent the right ear of listener 1111, whereas media device 1110 is disposed adjacent to the left ear of listener 1111, According to some embodiments, controller 1102*a* is configured to invoke channel manager 1102. Channel manager 1102 is configured to manage the spatial audio channels of a media device. Further, channel manager 1102 in one or both of media devices 1110 and 1120 can be configured to aggregate the channels of a media device to form an aggregated channel. For example, channel manager 1102 is configured to aggregate a first subset of transducers 1180 and a second subset of transducers 1181 to form an aggregated channel 1114. As such, spatial audio can be transmitted as an aggregated channel from transducers subsets 1180 and 1181. Thus, aggregated channel 1114 can constitute a left channel of spatial audio. Similarly, media device 1120 can be configured to form an aggregated channel 1124 as a right channel of spatial audio. Therefore, at least two subsets of transducers in media device 1120 are combined so that their functionality can provide aggregated channel 1124, which uses the selected filter for media device 1120. In a specific example, controller 1102*a* can invoke channel manager 1102 based on media device 1110 being, for example, no farther than 45 degrees CCW from plane 1167. Further, media device 1120 ought to be, in one example, no farther than 45 degrees CW from plane 1167.

In view of the foregoing, listener 1111 may have an enhanced auditory experience due to an addition of one or more media devices, such as media device 1120. Additional media devices may enhance or otherwise increase the volume achieved at position 1113 relative to a noise floor for the region in space.

Figure 12A:
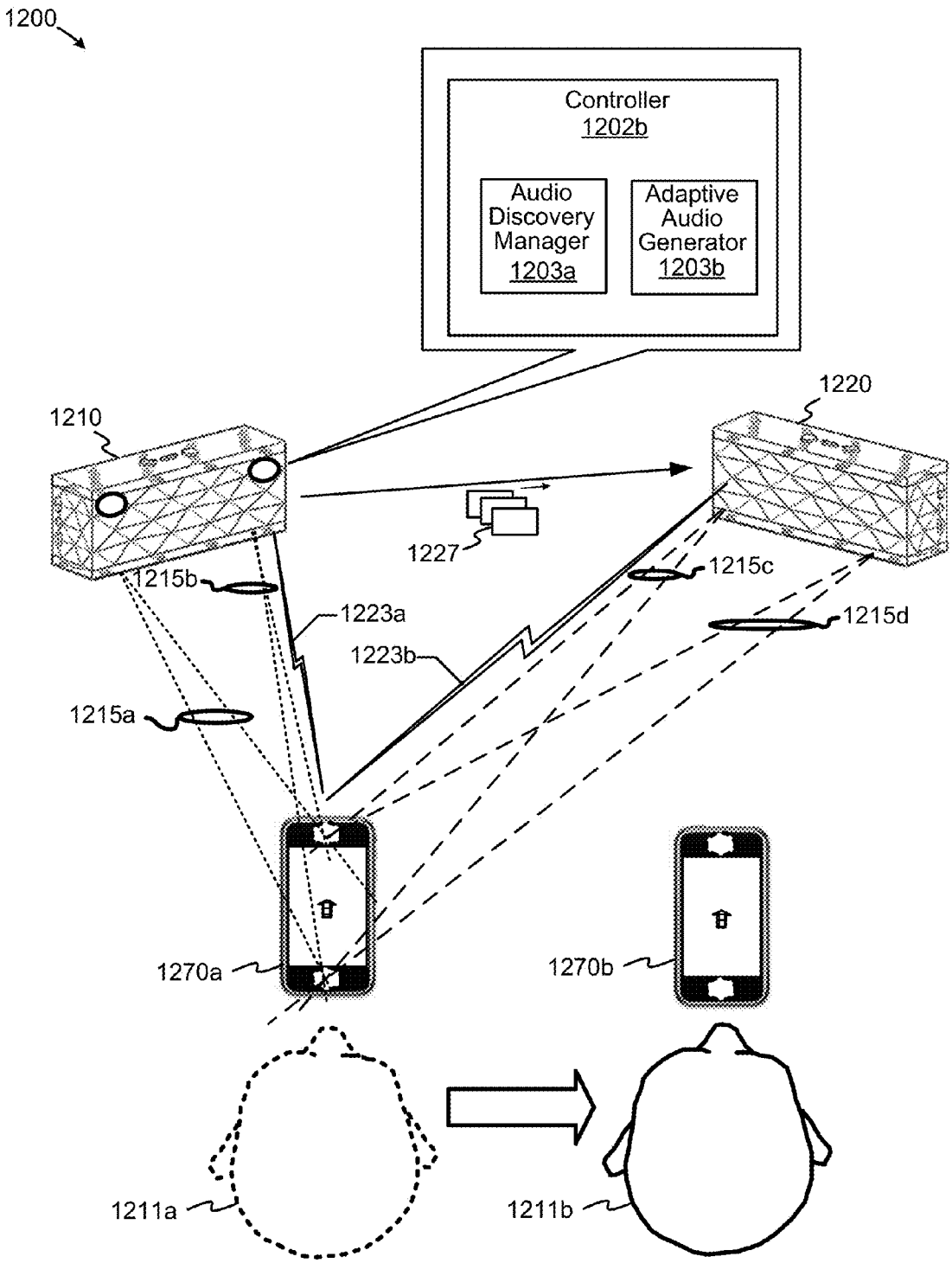
FIGS. 12A and 12B are diagrams depicting discovery of positions relating to a listener and multiple media devices, according to some embodiments.
Figure 12B:
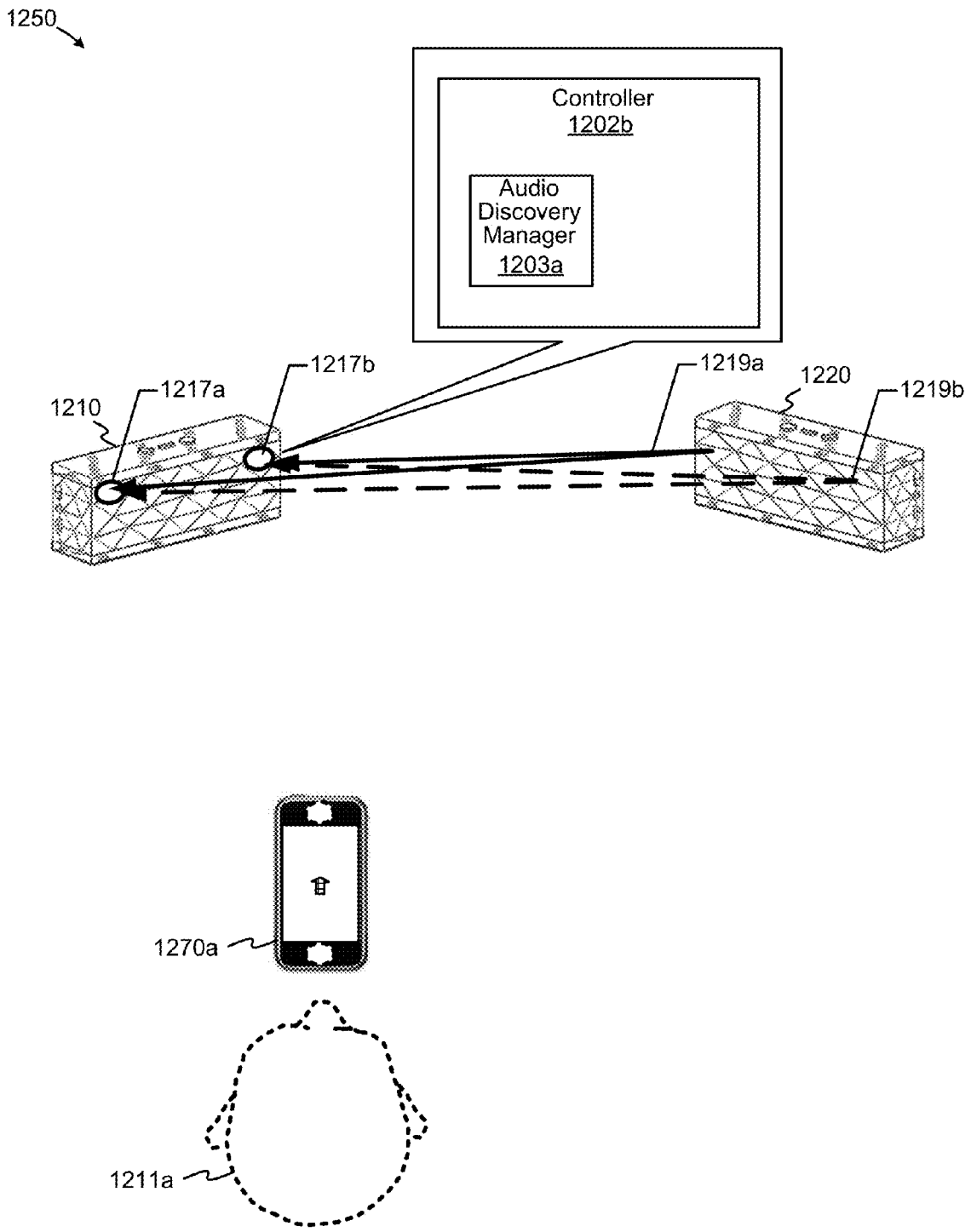

FIGS. 12A and 12B are diagrams depicting discovery of positions relating to a listener and multiple media devices, according to some embodiments. Diagram 1200 depicts a media device 1210 and another media device 1220 disposed in front of a listener 1211*a*. Media device 1210 includes controller 1202*b*, which, in turn, includes an audio discovery manager 1203*a* and an adaptive audio generator 1203*b*. Note that while diagram 1200 depicts controller 1202*b* disposed in media device 1210, media device 1220 can include a similar controller to facilitate projection of spatial audio to listener 1211*a*.

Similar to the determination of a position in FIG. 7, audio discovery manager 1203*a* is configured to generate acoustic probe signals 1215*a* and 1215*b* for reception at microphones of mobile device 1270*a*. Logic in mobile device 1270*a* can determine a relative position and/or relative orientation of mobile device 1270*a* to media device 1210. Further, media device 1220 can also be configured to generate acoustic probe signals 1215*c* and 1215*d* for reception at microphones of mobile device 1270*a*. Logic in mobile device 1270*a* can also determine a relative position and/or relative orientation of mobile device 1270*a* to media device 1220. Acoustic probe signals 1215*a*, 1215*b*, 1215*c*, and 1215*d*, at least in some cases, can include data representing a device ID to uniquely identify either media device 1210 or 1220, as well as data representing a channel ID to identify a channel or subset of transducers associated with one or more media devices. Other signal characteristics also may be used to distinguish acoustic probe signals from each other.

In one embodiment, a mobile device 1270*a* can provide via communication links 1223*a* and 1223*b* its calculated position to both media devices 1210 and 1220. Further, mobile device 1270*a* can share the calculated positions of the media devices among media device 1210 in media device 1220 to enhance, for example, the accuracy of determining the positions of the media devices and the listener. In another example, media device 1210 can be implemented as a master media device, thereby providing media device 1220 with data 1227 for purposes of facilitating the formation of aggregated channels of spatial audio.

Further to diagram 1200, controller 1202*b* includes an adaptive audio generator 1203*b*, for example, new filters in response to a listener at position 1211*a* moving to position 1211*b* (as well as phone moving from position 1270*a* to position 1270*b*). Adaptive audio generator 1203*b* is configured to implement one or more techniques that are described herein to determine a position of a listener, as well as a change in position of the listener.

FIG. 12B is a diagram depicting another example that facilitates the discovery of positions relating to a listener and multiple media devices, according to some embodiments. As shown, media device 1210 can include microphones 1217*a* and 1217*b*. During a discovery mode in which media device 1220 generates acoustic probes 1219*a* and 1219*b* for reception a mobile device at position 1270*a*, media device 1210 can also capture or otherwise receive those same acoustic probes. Audio discovery manager 1203*a*, therefore, can supplement information received from mobile device 1270*a* in FIG. 12A with acoustic probe information received in FIG. 12B. Note that media device 1220 can also use acoustic probes that emanate from media device 1210 during its discovery process for similar purposes. Note, too, that while FIGS. 12A and 12B exemplify the use of the acoustic probe signals, the various embodiments are not so limited. Media devices 1210 and 1220 can determine positions of each other as well as listener 1211*a* using a variety of techniques and/or approaches.

Figure 13:
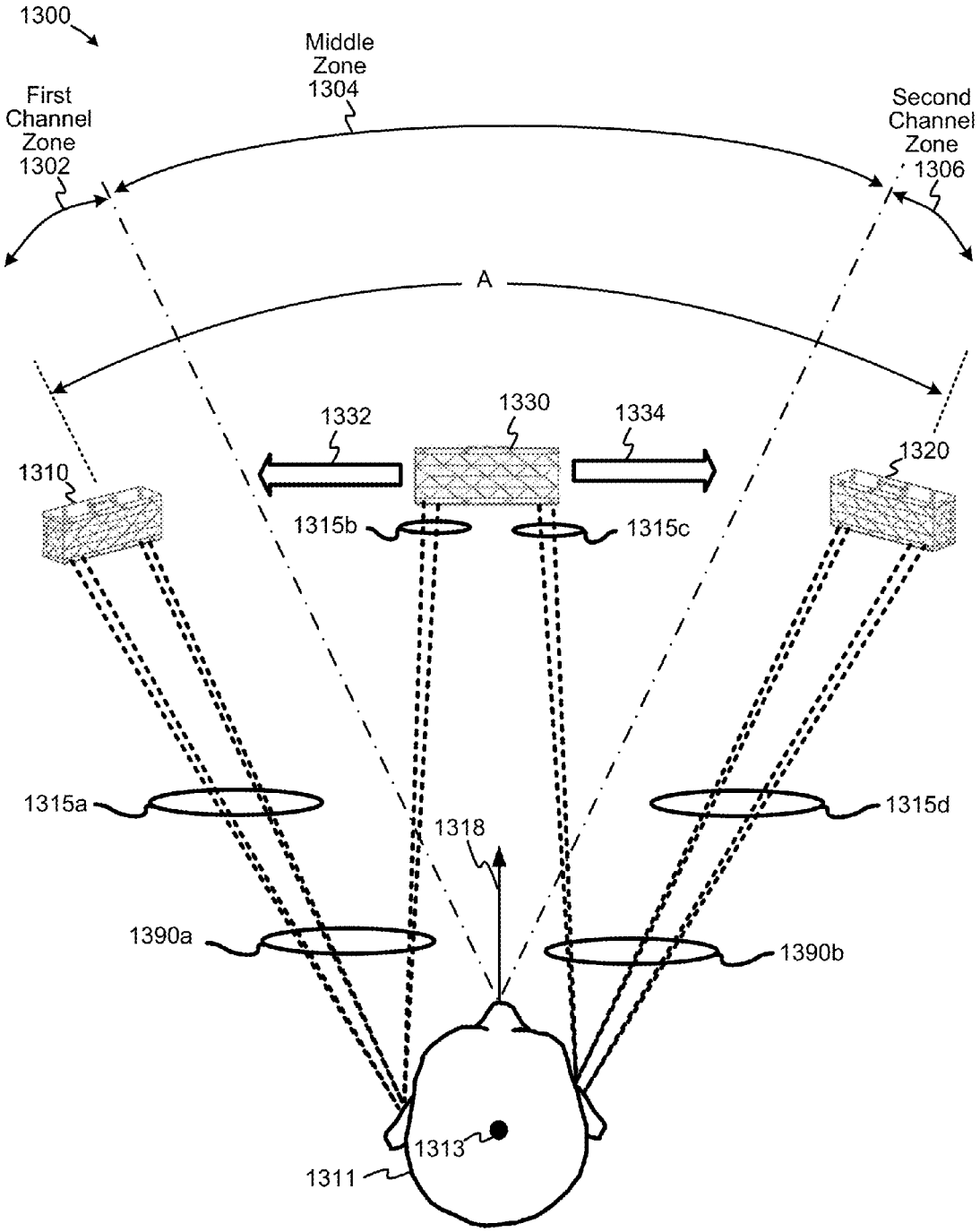
FIG. 13 is a diagram depicting channel aggregation based on inclusion of an additional media device, according to some embodiments.

FIG. 13 is a diagram depicting channel aggregation based on inclusion of an additional media device, according to some embodiments. Diagram 1300 depicts a first media device 1310 disposed in a first channel zone 1302 and configured to project an aggregated spatial audio channel 1315*a* to a listener 1311 at position 1313. A second media device 1320 is shown to be disposed in a second channel zone 1306, and configured to project an aggregated spatial audio channel 1315*d* to listener 1311. Media device 1310 is displaced by an angle "A" from media device 1320. Some examples, angle A is less than or equal to 90°. In other examples, the angle can vary.

Diagram 1300 further depicts a third media device 1330 being disposed in the middle zone 1304, which is located between zones 1302 and 1306. As shown, media device 1330 is disposed in a plane passing through reference line 1318. Thus, channel 1315*b* can be configured as a left spatial audio channel, whereas channel 1315*c* can be configured as a right spatial audio channel. According to some examples, a channel manager (not shown) in one or more media devices 1310, 1320, and 1330 can be configured to further aggregate channel 1315*a* with channel 1315*b* to form an aggregated channel 1390*a* over multiple media devices. Also, channel 1315*d* can be further aggregated with channel 1315*c* to form an aggregated channel 1390*b* over multiple media devices. According to some embodiments, media device 1330 can reduce the magnitude of channel 1315*b* (e.g., a left channel) as media device 1330 progressively moves toward second channel zone 1306 in direction 1334. Further, media device 1330 can reduce the magnitude of channel 1315*c* (e.g., a right channel) as media device 1330 progressively moves toward first channel zone 1302 in direction 1332.

Figure 14:
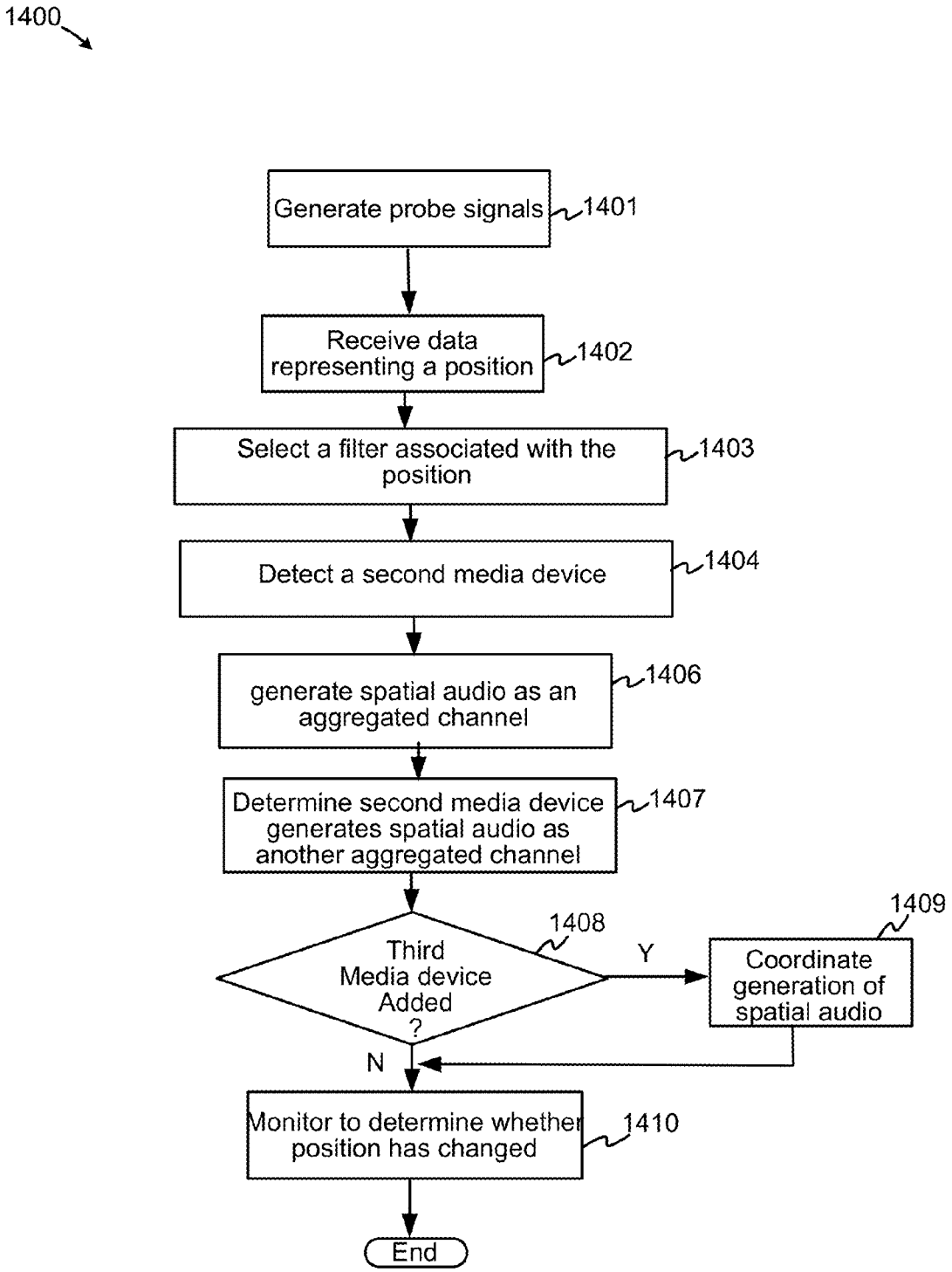
FIG. 14 is an example flow of implementing multiple media devices, according to some embodiments.

FIG. 14 is an example flow of implementing multiple media devices, according to some embodiments. Flow 1400 starts by generating probe signals at 1401 to determine positions of a listener and/or one or more media devices, and receiving data representing a position at 1402. At 1403, a filter associated with a position of a first media device is selected and spatial audio is generated as an aggregated channel (e.g., a left spatial audio channel) at 1406. At 1407, a first media device optionally can learn that a second media device is generating another aggregated channel (e.g., a right spatial audio channel). A determination is made at 1408 whether a third media device has been added. If not, flow 1400 moves to 1410 at which one or more positions are monitored determine whether any of the one or more positions of changed. Otherwise, flow 1400 moves to 1409 at which generation of spatial audio is coordinated amount any number of media devices.

Figure 15:
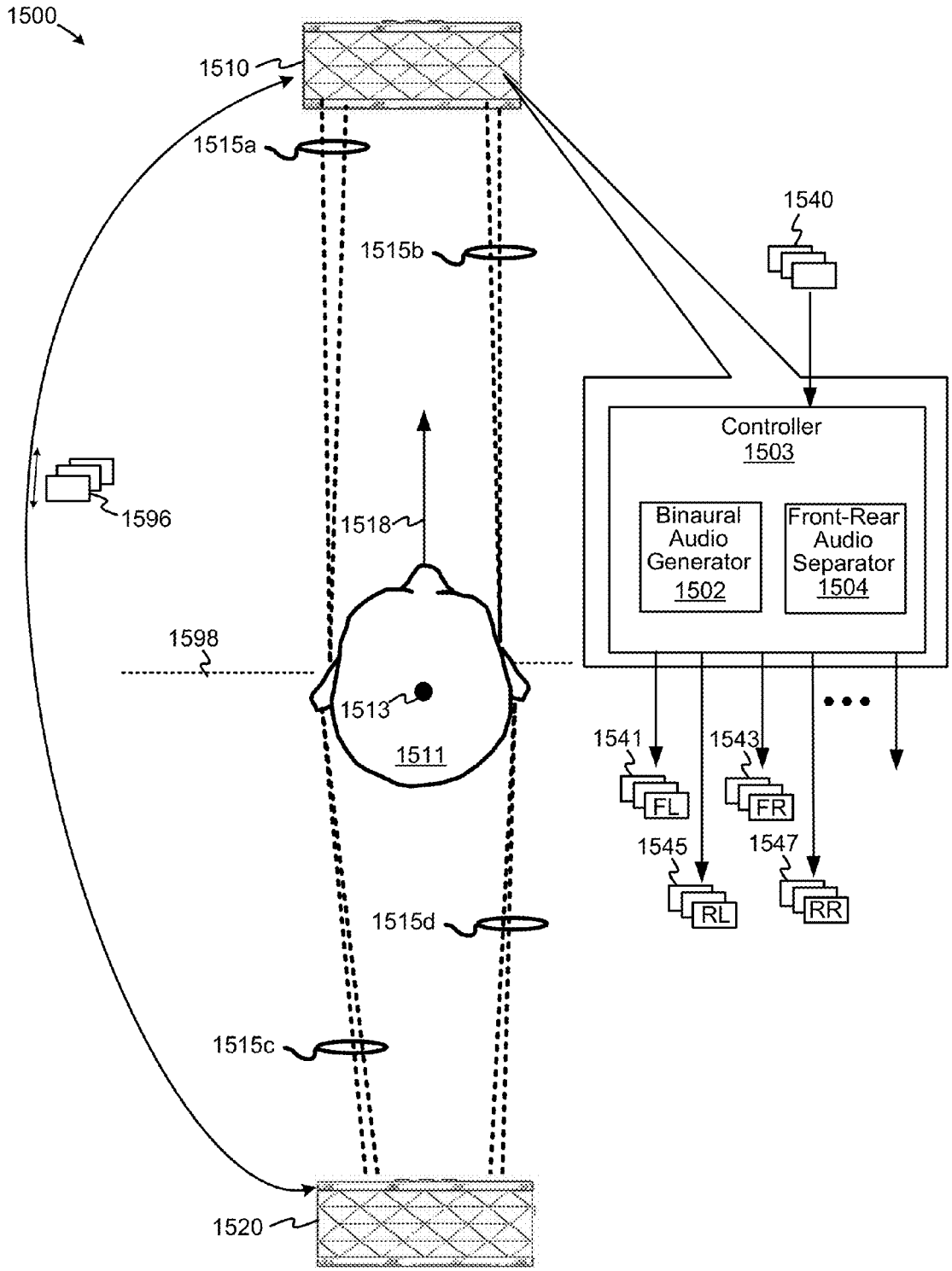
FIG. 15 is a diagram depicting another example of an arrangement of multiple media devices, according to some embodiments.

FIG. 15 is a diagram depicting another example of an arrangement of multiple media devices, according to some embodiments. Diagram 1500 depicts a first media device 1510 disposed in front of, or substantially in front of, listener 1511 at position 1513. Media device 1510 is disposed in a plane (not shown) coextensive with a reference line 1518, which shows a general orientation of user 1511. Further to diagram 1500, a second media device 1520 is disposed behind user 1511, and, thus, is disposed rearward region on the other side of plane 1598 (e.g., media device 1510 is disposed in a frontward region. In one implementation, addition of media device 1520 can enhance a perception of sound rearward (e.g., in the rear 180 degrees behind listener 1511). In some examples, rear externalization of spatial sound may be achieved based on an enhanced ratio of direct-to-ambient sound is provided behind listener 1511.

As shown, controller 1503 can be disposed in, for example, media device 1510, whereby controller 1503 can include a binaural audio generator 1502 and a front-rear audio separator 1504. Front-rear audio separator 1504 can be configured to divide or separate rear signals from front signals. In one example, front-rear audio separator 1504 can include a front filter bank and a rear filter bank for purposes of generating a proper spatial audio signal. In the example shown, front-left data ("FL") 1541 is configured to generate spatial audio as spatial audio channel 1515*a*, and front-right data ("FR") 1543 is configured to generate spatial audio as spatial audio channel 1515*b*. In one embodiment, front-rear audio separator 1504 generates rear-left data ("RL") 1545, which is configured to generate spatial audio as spatial audio channel 1515*c*. Front-rear audio separator 1504 also generates rear-right data ("RR") 1547 to implement spatial audio channel 1515*d*. Data 1545 and 1547 can be transmitted via a communications link as data 1596, whereby media device 1520 operates on the data. In other embodiments, a controller 1503 is disposed in media device 1520, which receives an audio signal via data 1596. Then, media device 1520 forms the proper rear-generated spatial audio signals.

In some examples, non-binaural signals can be received as a signal 1540. Binaural audio generator 1502 is configured to transform multi-channel, stereo, monaural, and other signals into a binaural audio signal. Binaural audio generator 1502 can include a re-mix algorithm.

Figure 16A:
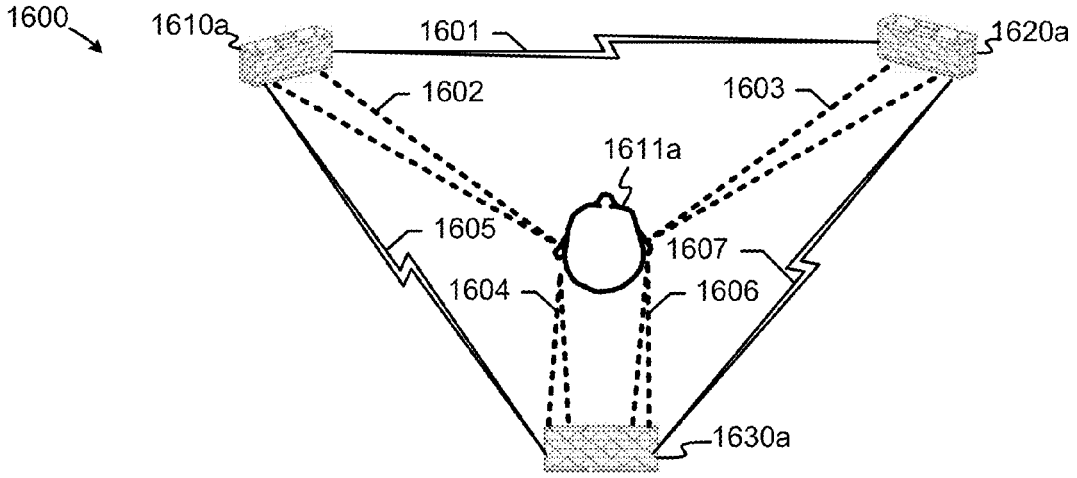
FIGS. 16A, 16B, and 16C depict various arrangements of multiple media devices, according to various embodiments.
Figure 16B:
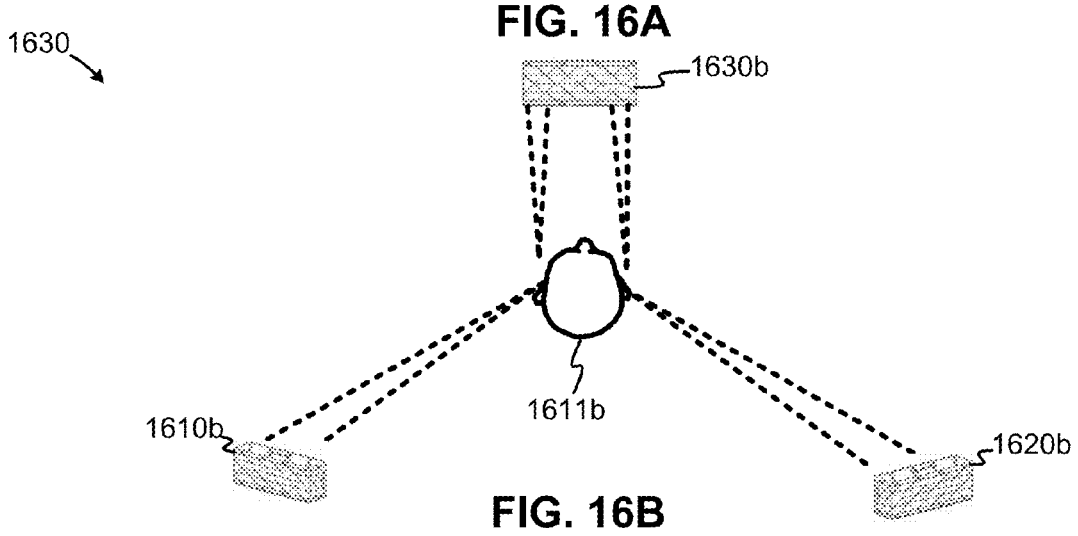
Figure 16C:
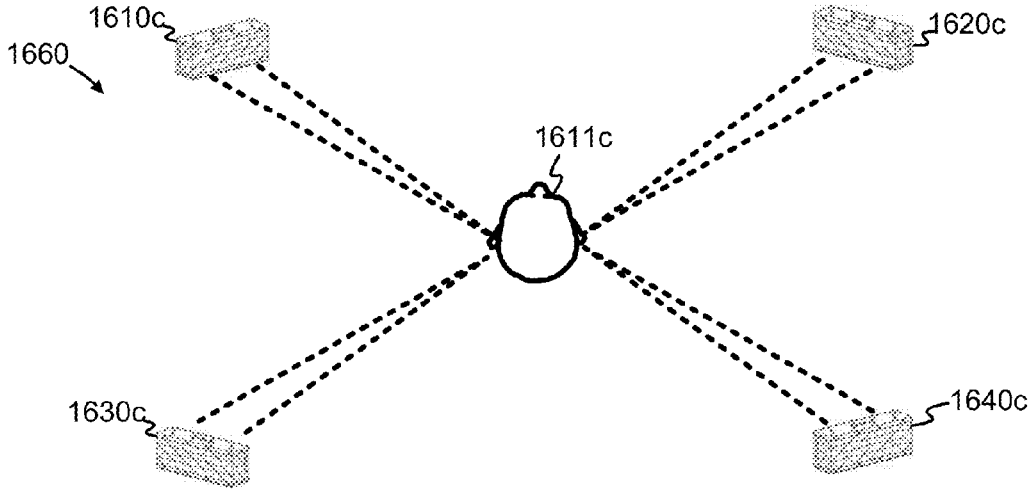

FIGS. 16A, 16B, and 16C depict various arrangements of multiple media devices, according to various embodiments. Diagram 1600 of FIG. 16A includes media devices 1610*a* and 1620*a* arranged in front of listener 1611*a* to provide spatial audio channels 1602 and 1603, respectively. Media device 1630*a* is disposed in a rearward region behind listener 1611*a*, and generates spatial audio channels 1604 and 1606. Communication links 1601, 1605, and 1607 facilitate communications among media devices 1610*a*, 1620*a*, and 1630*a* to confirm accuracy of information, such as position, whether a media device is locate in front or rear, etc.

Diagram 1630 of FIG. 16B includes media devices 1610*b* and 1620*b* arranged in back of listener 1611*b* to provide rear-based spatial audio channels. Media device 1630*b* is disposed in directly in front of listener 1611*b*, and generates spatial audio channels directed toward the front of listener 1611*b*.

Diagram 1660 of FIG. 16C includes media devices 1610*c* and 1620*c* arranged in front of listener 1611*c* to provide front-based spatial audio channels, whereas media device 1630*c* and 1640*c* are disposed in back of listener 1611*c* to generate rear-based spatial audio. The determination of positions of the media devices and listeners in FIGS. 16A, 16B, and 16C can performed as described herein.

Figure 17:
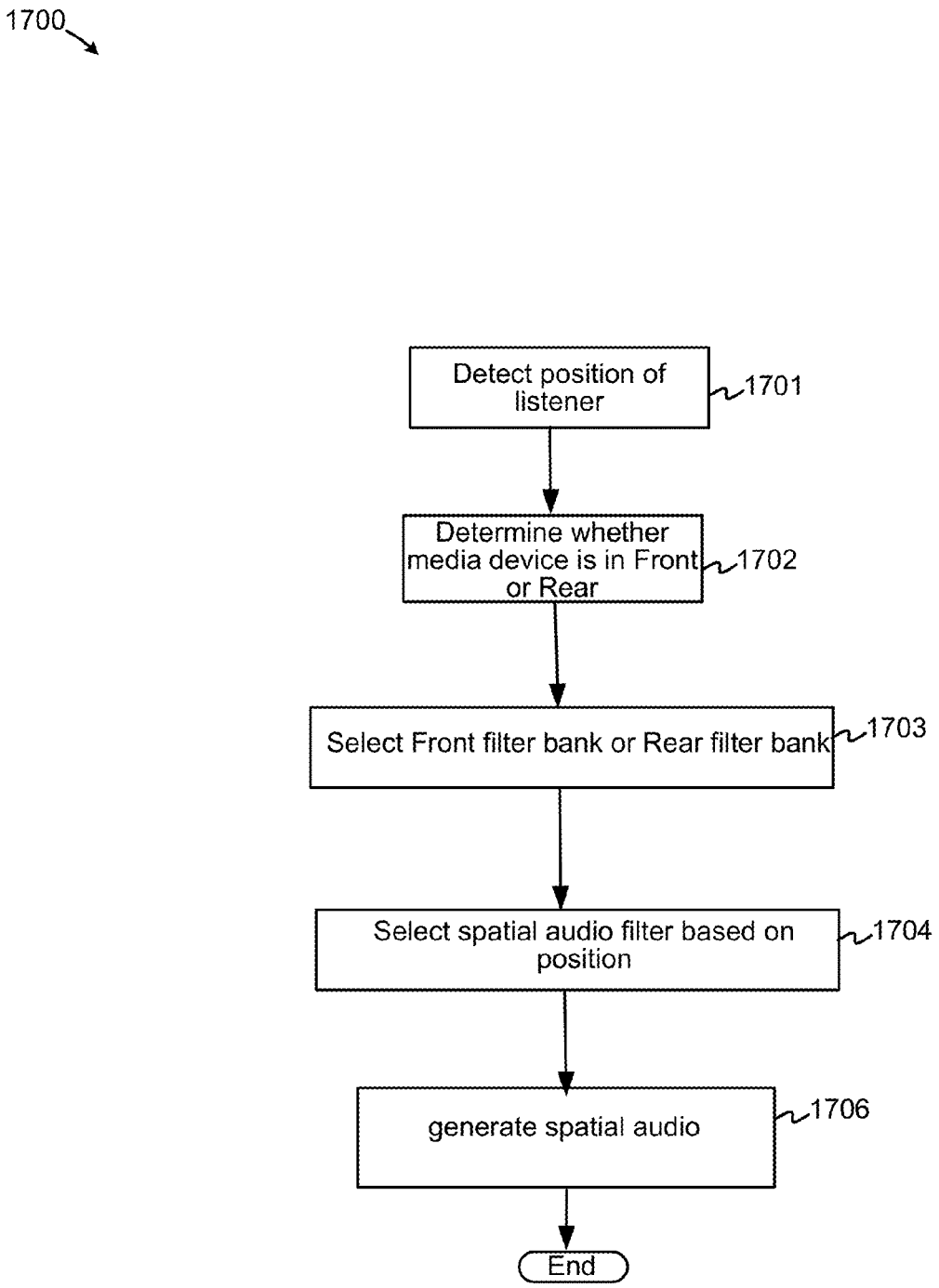
FIG. 17 is an example flow of implementing a media device either in front or behind a listener, according to some embodiments.

FIG. 17 is an example flow of implementing a media device either in front or behind a listener, according to some embodiments. Flow 1700 starts by detecting a position of a listener at 1701, and determining whether an associated media device is either disposed in front or in the rear at 1702. Depending on its position, a controller can select a front filter bank or a rear filter bank at 1703. A spatial audio filter based on a position is selected at 1704, and spatial audio is generated as either front-based or rear-base spatial audio in accordance with a spatial audio filter.

Figure 18:
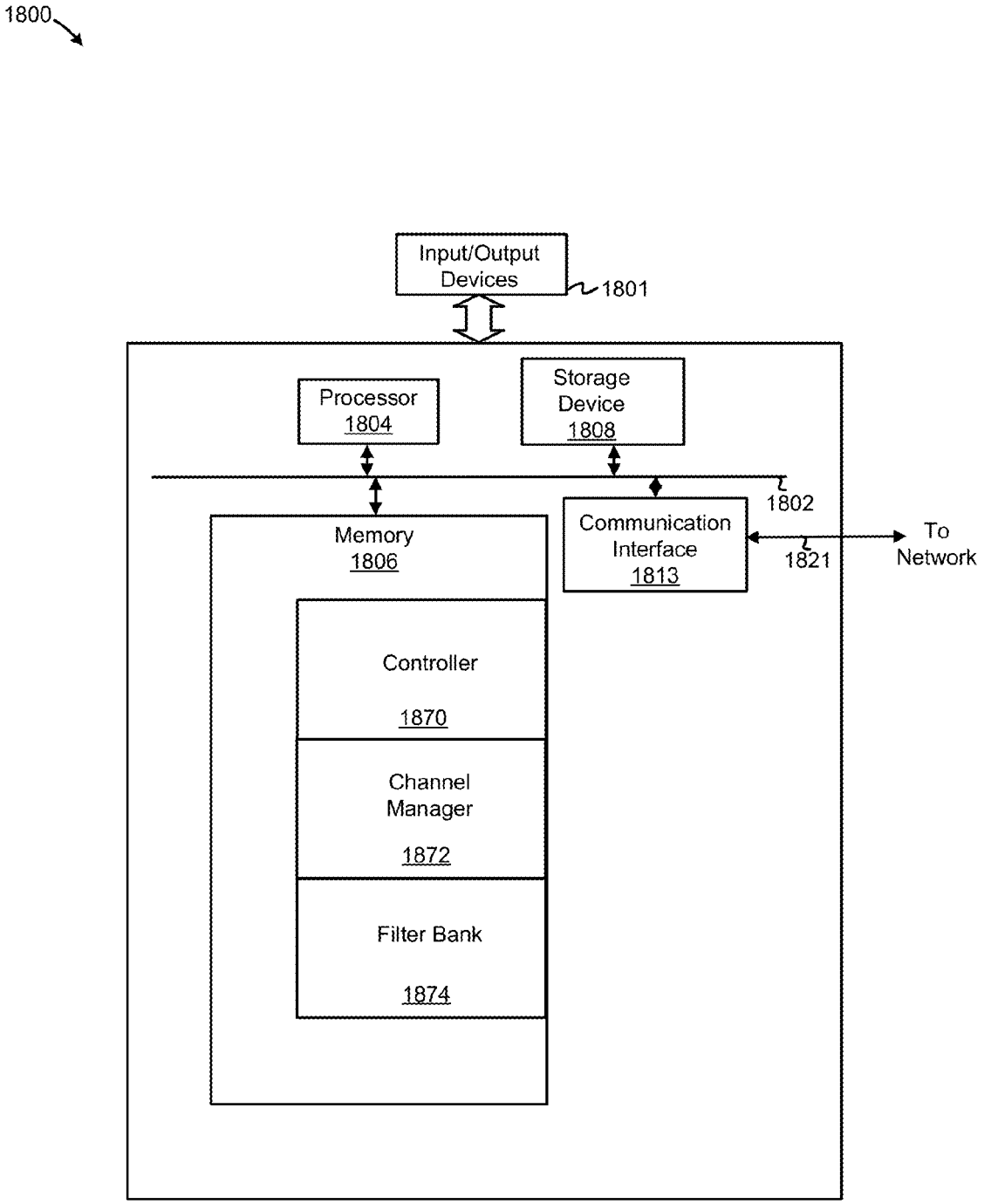
FIG. 18 illustrates an exemplary computing platform disposed in a media device in accordance with various embodiments.

FIG. 18 illustrates an exemplary computing platform disposed in a media device in accordance with various embodiments. In some examples, computing platform 1800 may be used to implement computer programs, applications, methods, processes, algorithms, or other software to perform the above-described techniques.

In some cases, computing platform can be disposed in a media device, an ear-related device/implement, a mobile computing device, a wearable device, or any other device.

Computing platform 1800 includes a bus 1802 or other communication mechanism for communicating information, which interconnects subsystems and devices, such as processor 1804, system memory 1806 (e.g., RAM, etc.), storage device 1808 (e.g., ROM, etc.), a communication interface 1813 (e.g., an Ethernet or wireless controller, a Bluetooth controller, etc.) to facilitate communications via a port on communication link 1821 to communicate, for example, with a computing device, including mobile computing and/or communication devices with processors. Processor 1804 can be implemented with one or more central processing units ("CPUs"), such as those manufactured by Intel® Corporation, or one or more virtual processors, as well as any combination of CPUs and virtual processors. Computing platform 1800 exchanges data representing inputs and outputs via input-and-output devices 1801, including, but not limited to, keyboards, mice, audio inputs (e.g., speech-to-text devices), user interfaces, displays, monitors, cursors, touch-sensitive displays, LCD or LED displays, and other I/O-related devices.

According to some examples, computing platform 1800 performs specific operations by processor 1804 executing one or more sequences of one or more instructions stored in system memory 1806, and computing platform 1800 can be implemented in a client-server arrangement, peer-to-peer arrangement, or as any mobile computing device, including smart phones and the like. Such instructions or data may be read into system memory 1806 from another computer readable medium, such as storage device 1808. In some examples, hard-wired circuitry may be used in place of or in combination with software instructions for implementation. Instructions may be embedded in software or firmware. The term "computer readable medium" refers to any tangible medium that participates in providing instructions to processor 1804 for execution. Such a medium may take many forms, including but not limited to, non-volatile media and volatile media. Non-volatile media includes, for example, optical or magnetic disks and the like. Volatile media includes dynamic memory, such as system memory 1806.

Common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, or any other medium from which a computer can read. Instructions may further be transmitted or received using a transmission medium. The term "transmission medium" may include any tangible or intangible medium that is capable of storing, encoding or carrying instructions for execution by the machine, and includes digital or analog communications signals or other intangible medium to facilitate communication of such instructions. Transmission media includes coaxial cables, copper wire, and fiber optics, including wires that comprise bus 1802 for transmitting a computer data signal.

In some examples, execution of the sequences of instructions may be performed by computing platform 1800. According to some examples, computing platform 1800 can be coupled by communication link 1821 (e.g., a wired network, such as LAN, PSTN, or any wireless network) to any other processor to perform the sequence of instructions in coordination with (or asynchronous to) one another. Computing platform 1800 may transmit and receive messages, data, and instructions, including program code (e.g., application code) through communication link 1821 and communication interface 1813. Received program code may be executed by processor 1804 as it is received, and/or stored in memory 1806 or other non-volatile storage for later execution.

In the example shown, system memory 1806 can include various modules that include executable instructions to implement functionalities described herein. In the example shown, system memory 1806 includes a controller 1870, a channel manager 1872, and filter bank 1874, one or more of which can be configured to provide or consume outputs to implement one or more functions described herein.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques. As hardware and/or firmware, the above-described techniques may be implemented using various types of programming or integrated circuit design languages, including hardware description languages, such as any register transfer language ("RTL") configured to design field-programmable gate arrays ("FPGAs"), application-specific integrated circuits ("ASICs"), or any other type of integrated circuit. According to some embodiments, the term "module" can refer, for example, to an algorithm or a portion thereof, and/or logic implemented in either hardware circuitry or software, or a combination thereof. These can be varied and are not limited to the examples or descriptions provided.

In some embodiments, a physiological sensor and/or physiological characteristic determinator can be in communication (e.g., wired or wirelessly) with a mobile device, such as a mobile phone or computing device, or can be disposed therein. In some cases, a mobile device, or any networked computing device (not shown) in communication with a physiological sensor and/or physiological characteristic determinator, can provide at least some of the structures and/or functions of any of the features described herein. As depicted herein the structures and/or functions of any of the above-described features can be implemented in software, hardware, firmware, circuitry, or any combination thereof. Note that the structures and constituent elements above, as well as their functionality, may be aggregated or combined with one or more other structures or elements. Alternatively, the elements and their functionality may be subdivided into constituent sub-elements, if any. As software, at least some of the above-described techniques may be implemented using various types of programming or formatting languages, frameworks, syntax, applications, protocols, objects, or techniques. For example, at least one of the elements depicted in any of the figure can represent one or more algorithms. Or, at least one of the elements can represent a portion of logic including a portion of hardware configured to provide constituent structures and/or functionalities.

For example, a physiological sensor and/or physiological characteristic determinator, or any of their one or more components can be implemented in one or more computing devices (i.e., any mobile computing device, such as a wearable device, an audio device (such as headphones or a headset) or mobile phone, whether worn or carried) that include one or more processors configured to execute one or more algorithms in memory. Thus, at least some of the elements depicted herein (or in any figure) can represent one or more algorithms. Or, at least one of the elements can represent a portion of logic including a portion of hardware configured to provide constituent structures and/or functionalities. These can be varied and are not limited to the examples or descriptions provided.

As hardware and/or firmware, the above-described structures and techniques can be implemented using various types of programming or integrated circuit design languages, including hardware description languages, such as any register transfer language ("RTL") configured to design field-programmable gate arrays ("FPGAs"), application-specific integrated circuits ("ASICs"), multi-chip modules, or any other type of integrated circuit. For example, a physiological sensor and/or physiological characteristic determinator, including one or more components, can be implemented in one or more computing devices that include one or more circuits. Thus, at least one of the elements depicted herein (or in any figure) can represent one or more components of hardware. Or, at least one of the elements can represent a portion of logic including a portion of circuit configured to provide constituent structures and/or functionalities.

According to some embodiments, the term "circuit" can refer, for example, to any system including a number of components through which current flows to perform one or more functions, the components including discrete and complex components. Examples of discrete components include transistors, resistors, capacitors, inductors, diodes, and the like, and examples of complex components include memory, processors, analog circuits, digital circuits, and the like, including field-programmable gate arrays ("FPGAs"), application-specific integrated circuits ("ASICs"). Therefore, a circuit can include a system of electronic components and logic components (e.g., logic configured to execute instructions, such that a group of executable instructions of an algorithm, for example, and, thus, is a component of a circuit). According to some embodiments, the term "module" can refer, for example, to an algorithm or a portion thereof, and/or logic implemented in either hardware circuitry or software, or a combination thereof (i.e., a module can be implemented as a circuit). In some embodiments, algorithms and/or the memory in which the algorithms are stored are "components" of a circuit. Thus, the term "circuit" can also refer, for example, to a system of components, including algorithms. These can be varied and are not limited to the examples or descriptions provided.

Although the foregoing examples have been described in some detail for purposes of clarity of understanding, the above-described inventive techniques are not limited to the details provided. There are many alternative ways of implementing the above-described invention techniques. The disclosed examples are illustrative and not restrictive.

What is claimed:

1. A method comprising:

receiving data representing a position for a region in space adjacent a first media device including a first subset of transducers associated with a first channel and a second subset of transducers associated with a second channel;

determining a second media device adjacent to the region in space;

determining a location of the second media device;

selecting a filter configured to project spatial audio to the region in space;

aggregating the first subset of transducers and the second subset of transducers to propagate either the first channel or the second channel as a first aggregated channel; and emitting the first aggregated channel from the first and the second subsets of transducers to the region in space.

2. The method of claim 1, wherein receiving the data representing the position comprises:

receiving data representing a first angle.

3. The method of claim 1, further comprising:

generating probe signals;

propagating a first subset of the probe signals via the first subset of transducers; and propagating a second subset of the probe signals VIa the second subset of transducers.

4. The method of claim 3, wherein generating the probe signals comprises:

generating acoustic probe signals including a first device identifier associated with the first media device.

5. The method of claim 3, further comprising:

receiving one or more subsets of data to determine the position as a function of the first and the second subsets of the probe signals.

6. The method of claim 5, further comprising:
receiving the one or more subsets of data via either an electronic communications link or an ultrasonic communications link, or both.

7. The method of claim 1, further comprising:
receiving a first subset of other probe signals and a second subset of other probe signals, the first and the second subsets of the other probe signals include a second device identifier associated with the second media device.

8. The method of claim 7, further comprising:
determining times at which the first subset of other probe signals and the second subset of other probe signals are received by the first media device; and
determining the location of the second media device based on the times.

9. The method of claim 1, further comprising:
establishing a portion of a communication link at the first media device; and
receiving data representing the location of the second media device from the second media device.

10. The method of claim 9, wherein receiving the data representing the location of the second media device comprises:
receiving data representing a second angle between the second media device and the position.

11. The method of claim 9, wherein receiving the data representing the location of the second media device comprises:
receiving data representing a third angle between a reference line of the second media device and the first media device.

12. The method of claim 1, further comprising:
establishing a portion of a communication link at the first media device; and
receiving data indicating that the second media device is configured to propagate the other of the first channel or the second channel as a second aggregated channel.

13. The method of claim 1, wherein selecting the filter comprises:
identifying the filter associated with the position; and
selecting the filter from a plurality of filters, each of which is associated with a different position.

14. The method of claim 13, further comprising:
detecting a change in the position to a next position;
determining a next angle associated with the next position; and
selecting a next filter.

15. The method of claim 1, further comprising:
detecting a third media device adjacent to the region in space; and
determining the third media device is between the first media device and the second media device.

16. The method of claim 15, further comprising:
determining the third media device is equidistant to the first media device and the second media device,
wherein one of a first subset of transducers and a second subset of transducers of the third media device is configured to emit the first aggregated channel, and the other of the first subset of transducers and the second subset of transducers of the third media device is configured to emit a second aggregated channel.

17. The method of claim 1, further comprising:
detecting a third media device adjacent to the region in space; and
determining the third media device is disposed on a second side of a plane passing through the region of space, the first media device and the second media device being disposed on a first side of the plane.

18. The method of claim 17, further comprising:
detecting the generation of one or more channels of rear-based spatial audio; and
propagating one of the one or more channels of the rear-based spatial audio from a first subset of transducers of the third media device; and
propagating the other of the one or more channels of the rear-based spatial audio from a second subset of transducers of the third media device.

19. The method of claim 17, further comprising:
detecting a fourth media device adjacent to the region in space;
identifying the fourth media device is disposed on a second side of a plane passing through the region of space, the first media device and the second media device being disposed on a first side of the plane; and
detecting the generation of one channel of rear-based spatial audio to be emitted via from a first subset and a second subset of transducers of the third media device.

20. A media device comprising:
a plurality of transducers configured to emit acoustic signal into an adjacent region, at least a subset of the plurality of transducers oriented relative to a reference line;
a plurality of filters configured to project spatial audio to a portion of the region in space, each of the filters corresponding to a different portion of the region in space;
a position determinator configured to determine a position adjacent the media device; and
a controller configured to determine a location of a second media device adjacent to the region in space and to select a filter associated with the position to propagate the spatial audio to the position, the controller further configured to aggregate the first subset of transducers and the second subset of transducers to propagate either a first channel or a second channel of spatial audio as a first aggregated channel, and emit the first aggregated channel from the first and the second subsets of transducers to the region in space.

* * * * *